US005819240A

United States Patent [19]

Kara

[11] Patent Number: 5,819,240

[45] Date of Patent: Oct. 6, 1998

[54] SYSTEM AND METHOD FOR GENERATING PERSONALIZED POSTAGE INDICA

[75] Inventor: Salim G. Kara, Houston, Tex.

[73] Assignee: E-Stamp Corporation, Houston, Tex.

[21] Appl. No.: 541,192

[22] Filed: Oct. 11, 1995

[51] Int. Cl.[6] ..... G07B 17/00

[52] U.S. Cl. ..... 705/408; 364/479.05; 705/410

[58] Field of Search ..... 364/464.02, 464.03, 364/479.01, 479.02, 479.03, 479.05, 464.11, 464.14, 464.18, 464.2, 464.21; 395/155, 326, 333, 334, 352, 353; 705/401, 404, 408, 410, 411

[56] References Cited

U.S. PATENT DOCUMENTS

| | | | |
|---|---|---|---|
| 4,511,793 | 4/1985 | Racanelli | 235/375 |
| 4,641,347 | 2/1987 | Clark et al. | 380/3 |
| 4,649,266 | 3/1987 | Eckert | 235/432 |
| 4,725,718 | 2/1988 | Sansone et al. | 235/495 |
| 4,743,747 | 5/1988 | Fougere et al. | 235/494 |
| 4,757,537 | 7/1988 | Edelmann et al. | 380/51 |
| 4,763,271 | 8/1988 | Field | 364/466 |
| 4,775,246 | 10/1988 | Edelmann et al. | 380/23 |
| 4,800,506 | 1/1989 | Axelrod et al. | 364/478 |
| 4,802,218 | 1/1989 | Wright et al. | 380/23 |
| 4,812,994 | 3/1989 | Taylor et al. | 364/464.02 |
| 4,831,554 | 5/1989 | Storace et al. | 364/464.02 X |
| 4,831,555 | 5/1989 | Sansone et al. | 364/464.02 X |
| 4,864,618 | 9/1989 | Wright et al. | 380/51 |
| 4,868,757 | 9/1989 | Gil | 364/464.03 |
| 4,900,903 | 2/1990 | Wright et al. | 235/380 |
| 4,900,904 | 2/1990 | Wright et al. | 235/381 |
| 4,901,241 | 2/1990 | Schneck | 364/464.02 |
| 5,025,141 | 6/1991 | Bolan | 235/472 |
| 5,065,000 | 11/1991 | Pusic | 235/381 |
| 5,091,771 | 2/1992 | Bolan et al. | 357/74 |
| 5,111,030 | 5/1992 | Brasington et al. | 235/375 |
| 5,119,306 | 6/1992 | Metelits et al. | 364/464.02 |
| 5,200,903 | 4/1993 | Gilham et al. | 364/464.02 |
| 5,239,168 | 8/1993 | Durst, Jr. et al. | 235/432 |
| 5,384,886 | 1/1995 | Rourke | 705/411 X |
| 5,471,925 | 12/1995 | Heinrich et al. | 364/464.02 X |
| 5,490,077 | 2/1996 | Freytag | 364/464.02 |
| 5,524,995 | 6/1996 | Brookner et al. | 400/596 |
| 5,602,742 | 2/1997 | Solondz et al. | 705/410 |
| 5,617,519 | 4/1997 | Herbert | 364/464.18 X |

FOREIGN PATENT DOCUMENTS

| | | |
|---|---|---|
| 0137737 | 4/1985 | European Pat. Off. . |
| 2580844 | 10/1986 | France . |
| 225121 | 7/1992 | United Kingdom . |
| WO8801818 | 3/1988 | WIPO . |

OTHER PUBLICATIONS

"Miniature, Coin–Shaped Chip is Read or Written With a Touch" New Release, Dallas Semiconductor, Jul. 1991.

*Primary Examiner*—Edward R. Cosimano
*Attorney, Agent, or Firm*—Fulbright & Jaworski L.L.P.

[57] ABSTRACT

A system and method for printing a postage meter stamp, including a desired postage amount and a personalized postage indicia, onto a piece of mail. A user takes a postal storage device to the Post Office in order to obtain a replenishment of the amount of postage stored within the postage storage device. A desired amount of postage is entered into the storage device by a postal employee through a processor-based system. The user is then able to access this stored postage at the user's location through a complementary processor-based system. The user is also able to create or to select one of a variety of graphical configurations of postage indicia to be imprinted as the postage meter stamp on a piece of mail.

70 Claims, 19 Drawing Sheets

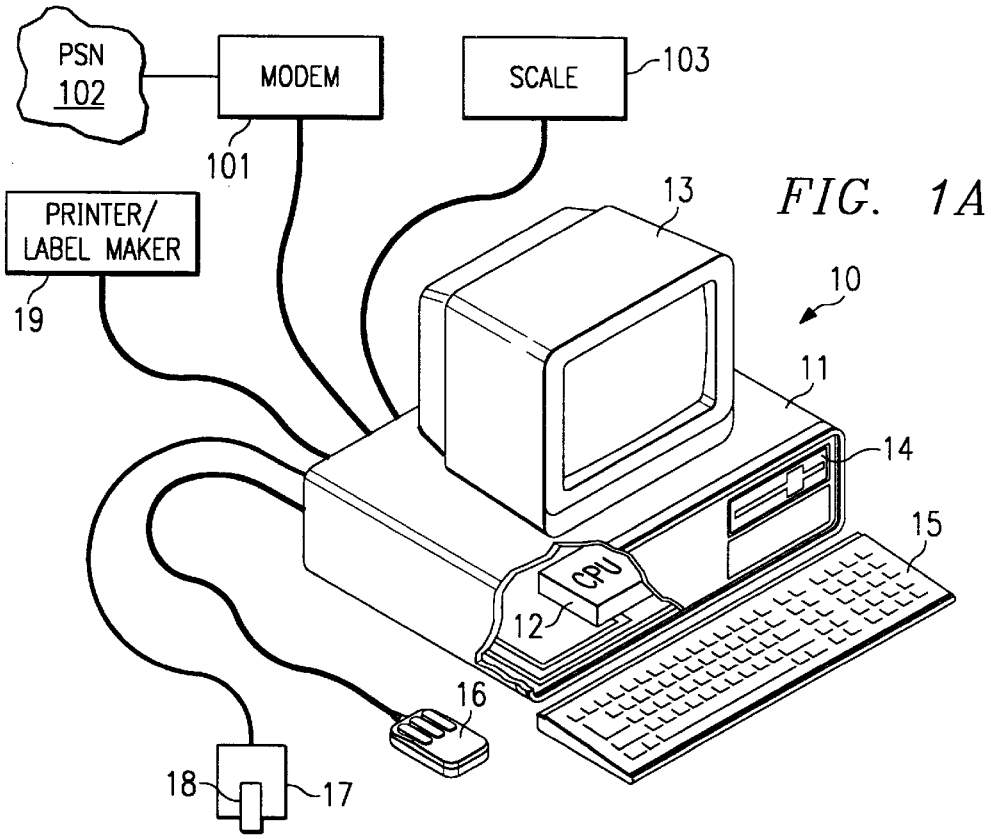
FIG. 1A
FIG. 1B
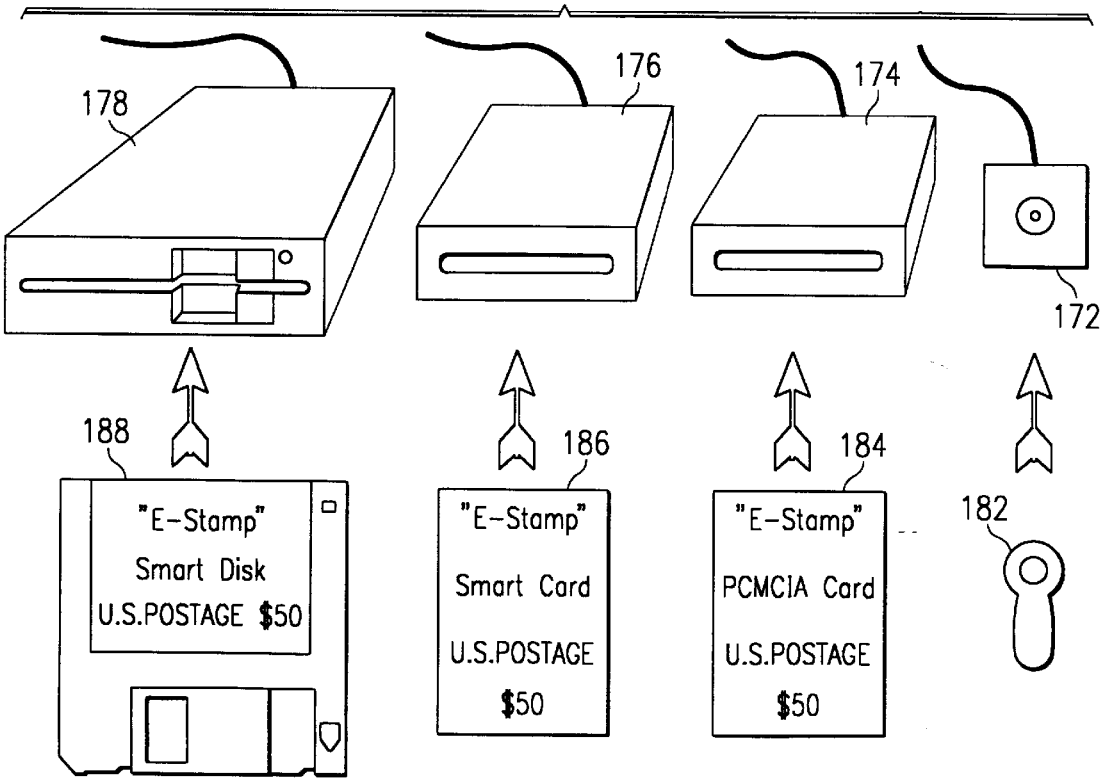

Post N Mail, Inc.
505 Cypress Station Dr. Suite # 505
Houston, Tx 77030-1612
Telephone (713)583-8909 Fax (713)699-0101

"E-Stamp"™ - Registration form

31 T.M.U. Button Serial #000000001 Date: April 20, 1994
32 E-Stamp Serial #000000001 Time: 01:29 AM
33

35
Registered user:
Individual Salim G. Kara Social Security # 636-18-0137
Organization Global Impex, Inc. Employer I.N. # 76-0422781
Address: 505 Cypress Station Dr.
Suite #505
City: Houston State: Tx Zipcode+4: 77090-1612
Telephone: (713)583-8909 Fax: (713)699-0101

Post N Mail License Agreement

38
This is a legal agreement between you (an individual or an entity), the end user, and Post N Mail, Inc. If you do not agree to the terms of this Agreement, promptly return the disk package and accompanying items (including all hardware, written materials and binders or other containers) to the place you obtained them for a full refund.
License
1. Grant of License.
2. Term of License.
3. Copyright.
4. Other restrictions.
5. Limited warranty.
6. Customer remedies.
7. No Other Warranties.
8. No Liability for Consequential Damages.

37

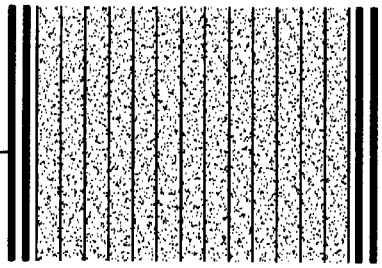

FIG. 3

Level 1: Password.

BCLINTON

Level 2: Algorithm 1.

p1 = (d1 + d4 + d7 + d10 + d13 + d16) mod 256
p2 = (d2 + d5 + d8 + d11 + d14 + d17) mod 256
p3 = (d3 + d6 + d9 + d12 + d15 + d18) mod 256
p4 = (d19 + d22 + d25 + d28 + d31 + d34) mod 256
p5 = (d20 + d23 + d26 + d29 + d32 + d35) mod 256
p6 = (d21 + d24 + 27 + d30 + d33 + d36) mod 256
p7 = (d37 + d38 + d39 + d40 + d41 + d42) mod 256
p8 = (d43 + d44 + d45) mod 256

Level 3: Algorithm 2.

p1 = d1 mod 256
p2 = (d2 + d3) mod 256
p3 = (d4 + d5 + d6) mod 256
p4 = (d7 + d8 + d9 + d10) mod 256
p5 = (d11 + d12 + d13 + d14 + d15) mod 256
p6 = (d16 + d17 + d18 + d19 + d20 + d21) mod 256
p7 = (d22 + d23 + d24 + d25 + d26 + d27 + d28) mod 256
p8 = (d29 + d30 + d31 + d32 + d33 + d34 + d35 + d36 + d37 + d38 + d39
+ d40 + d41 + d42 + d43 + d44 + d45) mod 256

*FIG. 6*

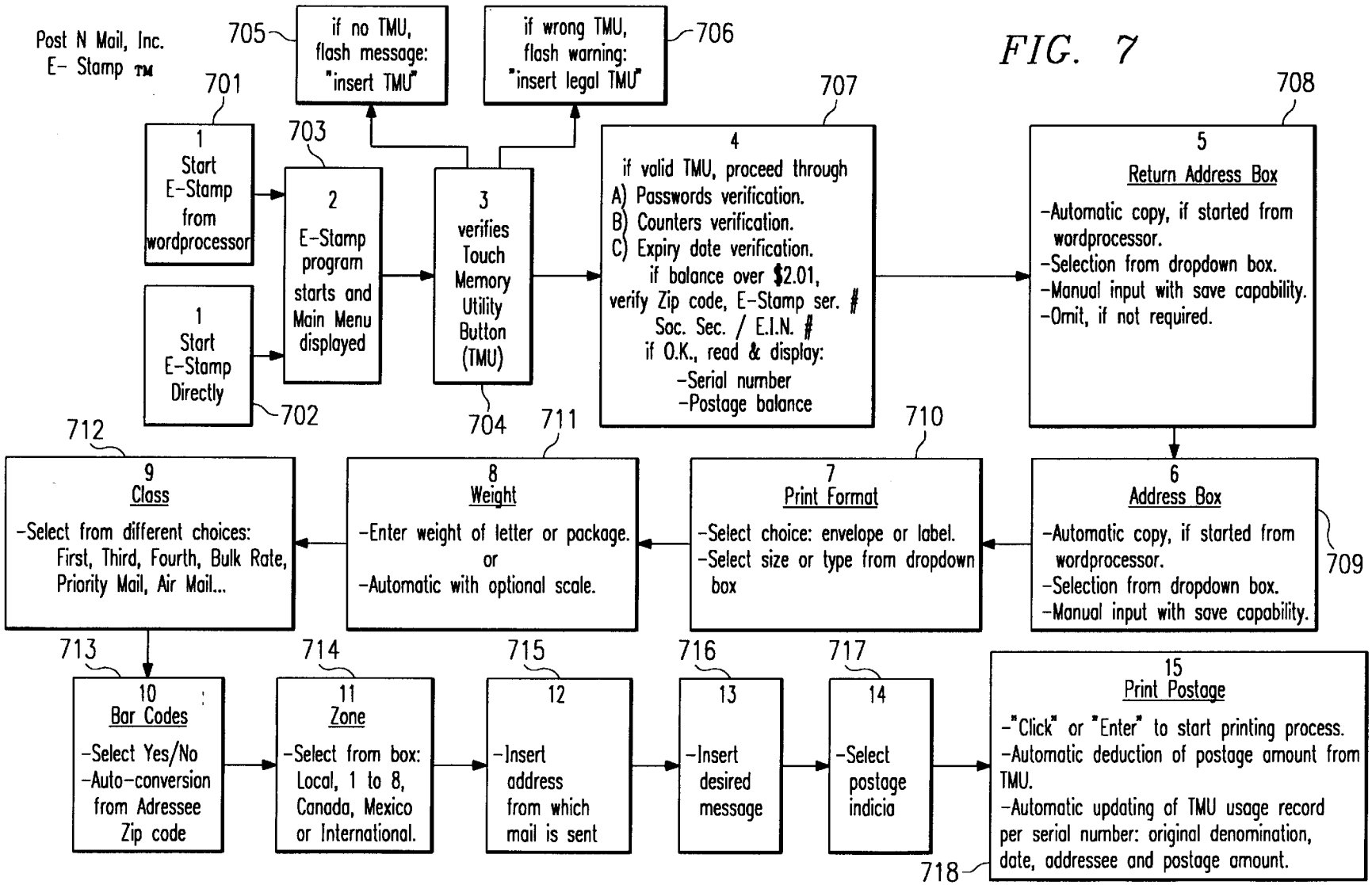
FIG. 7
Post N Mail, Inc.
E- Stamp ™
701
1
Start
E-Stamp
from
wordprocessor
702
1
Start
E-Stamp
Directly
703
2
E-Stamp
program
starts and
Main Menu
displayed
704
3
verifies
Touch
Memory
Utility
Button
(TMU)
705
if no TMU,
flash message:
"insert TMU"
706
if wrong TMU,
flash warning:
"insert legal TMU"
707
4
if valid TMU, proceed through
A) Passwords verification.
B) Counters verification.
C) Expiry date verification.
if balance over $2.01,
verify Zip code, E-Stamp ser. #
Soc. Sec. / E.I.N. #
if O.K., read & display:
-Serial number
-Postage balance
708
5
Return Address Box
-Automatic copy, if started from
wordprocessor.
-Selection from dropdown box.
-Manual input with save capability.
-Omit, if not required.
709
6
Address Box
-Automatic copy, if started from
wordprocessor.
-Selection from dropdown box.
-Manual input with save capability.
710
7
Print Format
-Select choice: envelope or label.
-Select size or type from dropdown
box
711
8
Weight
-Enter weight of letter or package.
or
-Automatic with optional scale.
712
9
Class
-Select from different choices:
First, Third, Fourth, Bulk Rate,
Priority Mail, Air Mail...
713
10
Bar Codes
-Select Yes/No
-Auto-conversion
from Adressee
Zip code
714
11
Zone
-Select from box:
Local, 1 to 8,
Canada, Mexico
or International.
715
12
-Insert
address
from which
mail is sent
716
13
-Insert
desired
message
717
14
-Select
postage
indicia
718
15
Print Postage
-"Click" or "Enter" to start printing process.
-Automatic deduction of postage amount from
TMU.
-Automatic updating of TMU usage record
per serial number: original denomination,
date, addressee and postage amount.

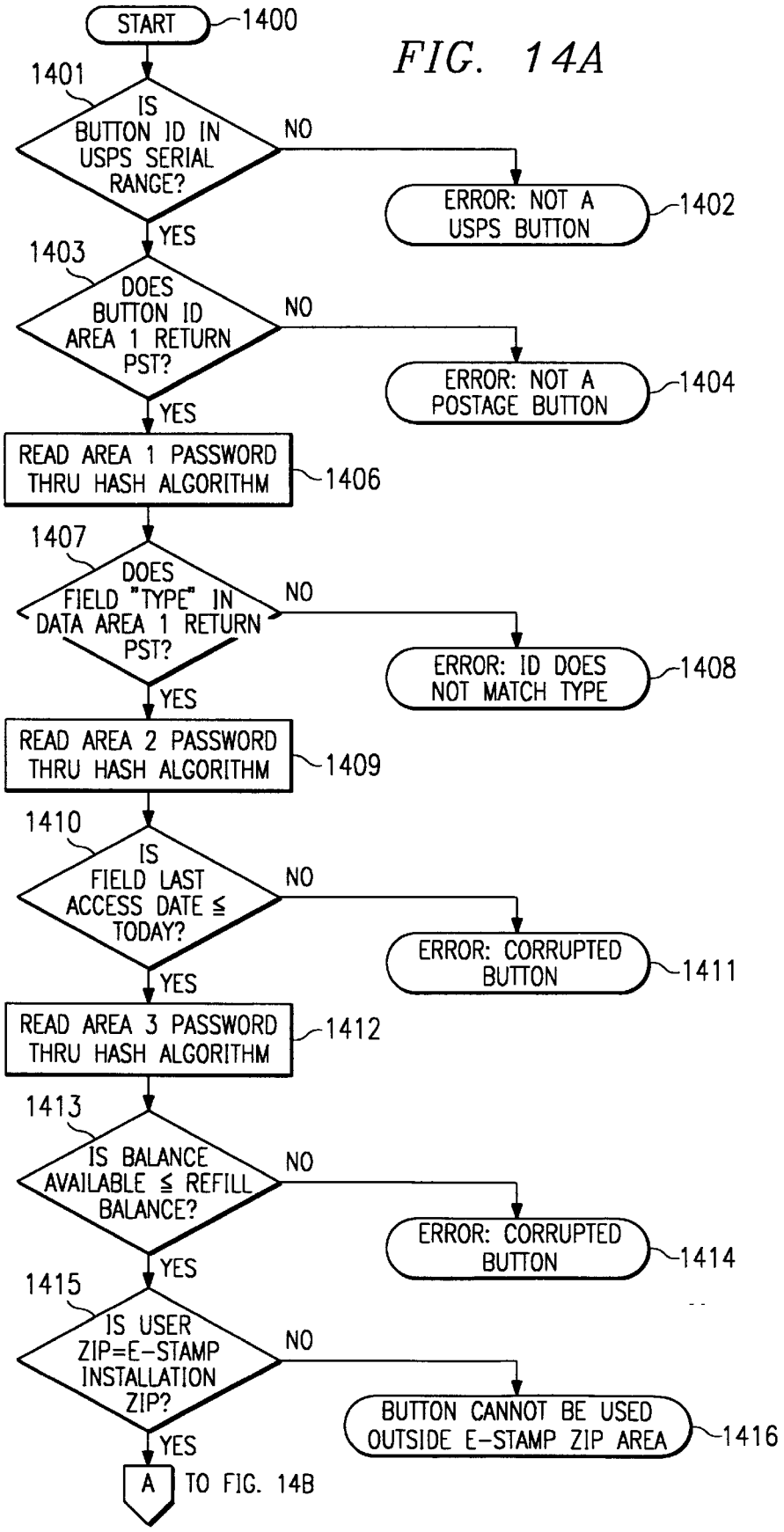
START
1400
FIG. 14A
1401
IS BUTTON ID IN USPS SERIAL RANGE?
NO
ERROR: NOT A USPS BUTTON
1402
YES
1403
DOES BUTTON ID AREA 1 RETURN PST?
NO
ERROR: NOT A POSTAGE BUTTON
1404
YES
READ AREA 1 PASSWORD THRU HASH ALGORITHM
1406
1407
DOES FIELD "TYPE" IN DATA AREA 1 RETURN PST?
NO
ERROR: ID DOES NOT MATCH TYPE
1408
YES
READ AREA 2 PASSWORD THRU HASH ALGORITHM
1409
1410
IS FIELD LAST ACCESS DATE ≤ TODAY?
NO
ERROR: CORRUPTED BUTTON
1411
YES
READ AREA 3 PASSWORD THRU HASH ALGORITHM
1412
1413
IS BALANCE AVAILABLE ≤ REFILL BALANCE?
NO
ERROR: CORRUPTED BUTTON
1414
YES
1415
IS USER ZIP=E-STAMP INSTALLATION ZIP?
NO
BUTTON CANNOT BE USED OUTSIDE E-STAMP ZIP AREA
1416
YES
A
TO FIG. 14B

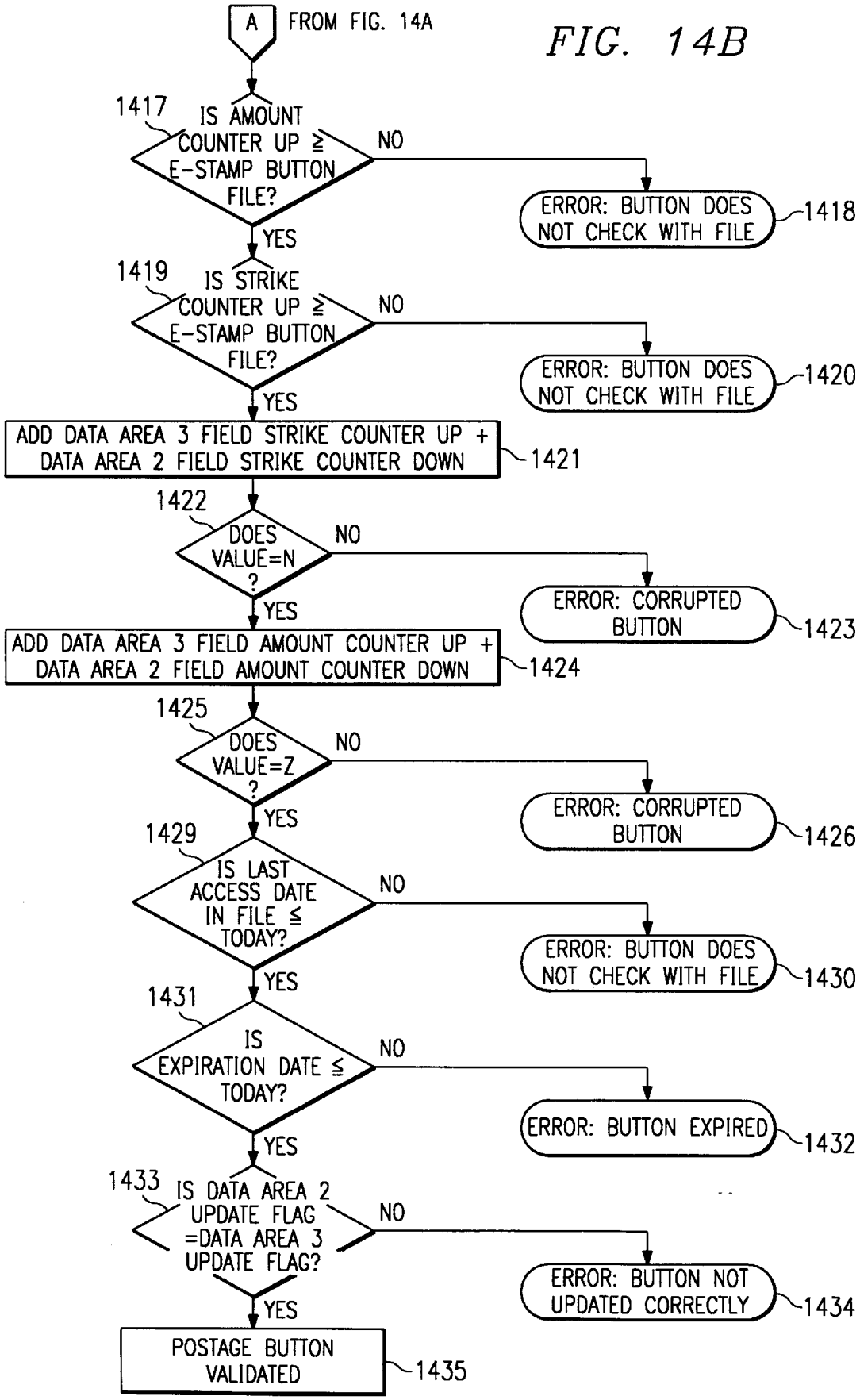
A
FROM FIG. 14A
FIG. 14B
1417
IS AMOUNT COUNTER UP ≥ E-STAMP BUTTON FILE?
NO
ERROR: BUTTON DOES NOT CHECK WITH FILE
1418
YES
1419
IS STRIKE COUNTER UP ≥ E-STAMP BUTTON FILE?
NO
ERROR: BUTTON DOES NOT CHECK WITH FILE
1420
YES
ADD DATA AREA 3 FIELD STRIKE COUNTER UP + DATA AREA 2 FIELD STRIKE COUNTER DOWN
1421
1422
DOES VALUE=N ?
NO
ERROR: CORRUPTED BUTTON
1423
YES
ADD DATA AREA 3 FIELD AMOUNT COUNTER UP + DATA AREA 2 FIELD AMOUNT COUNTER DOWN
1424
1425
DOES VALUE=Z ?
NO
ERROR: CORRUPTED BUTTON
1426
YES
1429
IS LAST ACCESS DATE IN FILE ≤ TODAY?
NO
ERROR: BUTTON DOES NOT CHECK WITH FILE
1430
YES
1431
IS EXPIRATION DATE ≤ TODAY?
NO
ERROR: BUTTON EXPIRED
1432
YES
1433
IS DATA AREA 2 UPDATE FLAG =DATA AREA 3 UPDATE FLAG?
NO
ERROR: BUTTON NOT UPDATED CORRECTLY
1434
YES
POSTAGE BUTTON VALIDATED
1435

SYSTEM AND METHOD FOR GENERATING PERSONALIZED POSTAGE INDICA

REFERENCE TO RELATED APPLICATIONS

This application is related to concurrently filed, copending, commonly assigned patent application, entitled "SYSTEM AND METHOD FOR PRINTING PERSONALIZED POSTAGE INDICIA ON GREETING CARDS", Ser. No. 08/540,658, (Attorney Docket No. P0004) which is hereby incorporated by reference herein.

TECHNICAL FIELD OF THE INVENTION

This invention relates, in general, to a portable postage storage device that can be coupled to processor-based systems to receive and retrieve an amount of authorized postage and the printing of a personalized postage indicia. More specifically, the invention relates to a system and method, under the control of a general purpose computer, for automatically calculating the amount of postage due for a particular piece of mail and imprinting that amount of postage in a personalized configuration of a meter stamp on an item of mail.

BACKGROUND OF THE INVENTION

Presently, it is common for individuals or businesses to have residing within their offices a postage meter rented from a commercial business such as, for example, Pitney Bowes. This arrangement is very convenient, since letters may be addressed, postage applied, and mailed directly from the office without requiring an employee to physically visit the U.S. Post Office and wait in line in order to apply postage to what is often a quite significant volume of outgoing mail, or to manually apply stamps to each piece of mail in which case mail is slower because it has to go through a postage cancelling machine.

Quite naturally, postage meters were developed to relieve the manual application of stamps on mail and to automate the above process. Nevertheless, a postage meter residing within an office is not all that convenient and efficient as it may first seem to be. First, a postage meter may not be purchased, but must be rented. The rental fees alone are typically over twenty dollars per month. For a small business, this can be quite an expense to incur year after year. Second, a postage meter must be adjusted, serviced and replenished manually; e.g., each day the date must be adjusted manually, periodically the stamp pad must be re-inked, and when the amount of postage programmed within the postage meter has expired, the postage in the meter must be replenished. To be replenished, a postage meter must be manually unplugged, placed into a special case (the meter is of a significant weight), and an employee must visit a U.S. Post Office to have the meter reprogrammed with additional postage. Upon arrival at the U.S. Post Office, a teller must cut the seal, replenish the meter with a desired amount of postage, and reseal the meter before returning it to the employee. The meter must then be returned to the office and powered up.

A slightly more expensive meter (rental of approximately $30.00 more) works in the following manner: 1) a user sets up an account with Pitney Bowes, 2) 7 to 10 days before a user requires any postage, the user deposits with the meter owner the amount of postage required, 3) the user then calls the owner (7 to 10 days later) and they issue instructions as to the manual pushing of a variety of buttons on the meter (programming) which will replenish the postage amount on the meter. Nonetheless, the meter must be taken to the Post Office every 6 months.

Thus, in addition to the monthly rent, the servicing and replenishing of the meter requires the time and expense of at least one employee to take the meter to the U.S. Post Office to have it checked. Of course, this procedure results in down-time wherein the postage meter is not available to the business for the application of postage to outgoing mail. In addition, because of the monthly rent and the size of these devices, it is generally not practical for businesses to have more than one postage meter to alleviate this down-time.

As previously mentioned, the alternative to a business, especially a small business, is to forego the advantages of a postage meter and to buy sheets, or books, of stamps. Without a doubt, this is not a sufficient solution. Since a variety of denominations of stamps are generally required, applying two 32¢ stamps to a letter requiring only 40¢, will begin to add up over time. Additionally, it is difficult for a business to keep track of stamp inventories and stamps are subject to pilferage and degeneration from faulty handling. Moreover, increases in the postal rate (which seem to occur every three years) and the requirement for variable amounts of postage for international mail, makes the purchase of stamps even more inefficient and uneconomical.

Because of different postage zones, different classes of mail, different postage required by international mail and the inefficiency of maintaining stamps within an office, it is important to have an automatic postage system, such as the aforementioned inefficient and relatively expensive postage meter.

However, the traditional postage meter does not allow the individual or business to take advantage of commemorative stamps designed and printed by the Post Office. Although individuals often purchase and collect various editions of commemorative stamps, businesses will generally forego buying commemorative stamps because the large variety of stamps available would only complicate their stamp inventory.

Since the outside of an envelope is usually the first contact a mail recipient has with the sender, it is desirable to make a good "first impression" on the mail recipient. It is also desirable for a commercial user to add a message unique to his or her business and perhaps even tailored on a recipient-by-recipient basis.

Accordingly, there is a need in the art for a system and method that provides the automatic placement of postage on mail at locations other than a U.S. Post Office, while not requiring the use of a traditional postage meter, and which allows for the addition of unique postage indicia to be printed along with the postage.

One major problem with any system in which a portable memory is used for controlling available values in a computer system, such as the amount of postage available to a user, is the maintenance of strict controls on the "filling" of the memory. Any such controls must have as a component the ability to create an audit trail and the ability to withstand unauthorized usage.

Another problem facing any CPU based system with a portable memory to store postage is that the system should optimally interface with a user friendly operating environment that is flexible and can be coupled to other programs such as a word processing or graphics program.

Thus, it is one object of the invention to provide a system and method whereby various configurations of postage indicia can be established by the user of the portable memory device.

It is a further object of the invention to provide a system and method whereby the user can select from several configuration of postage indicia which he/she desires to print on an item of mail.

It is a still further object of the invention to provide a system and method whereby a user can import personalized, or customized, postage indicia graphics into the interface program which allows a CPU to read a portable memory device, and to print this customized indicia on a piece of mail.

SUMMARY OF THE INVENTION

These and other objects and features are accomplished in a preferred embodiment of the present invention, in which a processor-based system is a personal computer ("PC") located within a business' office or an individual's home. The PC stores a program, hereinafter referred to as the "E-STAMP" program, which requests input from the user on the amount of desired postage and the configuration of the desired postage indicia and subsequently prints on an envelope, a letter or a label through a printer, or a special purpose label-maker, coupled to the PC the desired postage indicia designating the appropriate amount of postage. The desired amount of postage is printed as a meter stamp and may contain encrypted information for security purposes or may be customized as desired by the user. The E-STAMP program interfaces with the user through the display screen and the keyboard, or mouse, of the PC.

In the preferred embodiment of the present invention, the E-STAMP program may be coupled to a graphics program residing within the processor-based system, thus allowing the customer to select a personalized graphic design for the postage meter indicia to be printed on the mail. The user can construct his/her own design using any of the well-known drawing programs, such as, for example, Macromedia's FreeHand program, which is hereby incorporated by reference herein; or the user can select from an established data base of graphics, either self-designed or obtained from either the post office on the portable postage memory or from other graphics suppliers via diskette data loaded into a general application program running on the PC.

Furthermore, the E-STAMP program may also be programmed to print the address, return address and meter stamp on correspondence. This correspondence can then be placed in envelopes with cutouts or glassine paper at the appropriate areas so that the address, return address and/or meter stamp can be visualized through the envelope.

In another preferred embodiment of the present invention, a touch memory utility ("TMU") button, manufactured by, for example, Dallas Semiconductor, Dallas, Tex., is utilized for transferring the purchased amount of postage from the U.S. Post Office to the processor based system at the user's office. Typically, a user will physically take the TMU button to (or purchase from) a U.S. Post Office location, that Post Office having a system complementary to the one installed on the customer's PC. A postal worker will interface the TMU button with the system residing at the Post Office in order to replenish the amount of postage programmed within the button in an amount requested and purchased by the customer. The customer may also select from a variety of postage meter stamp designs that the Post Office can input into the portable memory device. The user may also call a number (an authorized Post Office telephone number) and have the Post Office transfer the required amount of postage by modem.

The Post Office may also elect to sell disposable TMU buttons pre-loaded in various denominations. These disposable TMU buttons may be sold either at the Post Office window or through machines in the Post Office lobby. The Post Office may sell a variety of TMU buttons that have been loaded with postage meter stamps of different designs, such that when the TMU button is coupled to the E-STAMP program that a specific design of postage meter stamp will be printed on the letter, envelope, or label.

The customer will then physically carry the button back to the processor-based system, couple the button to a corresponding receiving apparatus coupled to the processor-based system so that portions of the stored postage may be downloaded to the E-STAMP program upon a request by the customer. Upon invocation of the E-STAMP program by the customer, the program will inform the customer of the newly obtained amount of postage via the display screen.

In yet another preferred embodiment of the present invention, the display screen coupled to the processor-based system employs a "windows" type display for interfacing with the user. Through the display screen, the E-STAMP program will request a password from the user and the amount of postage the user wishes to apply to a piece of outgoing mail or corresponding label for subsequent application to a package or envelope. The user will enter the desired amount of postage, the program will retrieve this postage stored within the TMU button, and the E-STAMP program will print a meter stamp through a coupled printing device onto the outgoing mail or label.

In still yet another preferred embodiment of the present invention, the E-STAMP program may be coupled to a word processing program residing within the processor-based system. As a result, the application of the meter stamp may be made in conjunction with the word processing program, which has the capability to print envelopes, separately or in conjunction with the printing of a corresponding letter produced by the word processing program.

In another preferred embodiment of the present invention, the aforementioned TMU buttons are specially manufactured by Dallas Semiconductor for use in conjunction with E-STAMP programs, i.e., unique serial numbers specific to the E-STAMP program are embedded within each TMU button. These serial numbers are then provided to the U.S. Post Office for programming into their corresponding POSTAGEMAKER program and system. Thus, a form of security is provided since only the TMU buttons specially manufactured for use with the E-STAMP program are able to receive or retrieve data pertaining to postage amounts, as previously described.

Additionally, a special password could be dedicated for use with the POSTAGEMAKER program so that access is only provided to users entering the correct password. As a result of the aforementioned, the U.S. Post Office can be assured that only authorized users are able to obtain postage replenishment, and that users are unable to replenish their postage within the TMU button without cooperation from the U.S. Post Office. The aforementioned serial numbers and passwords may also allow a user and the U.S. Post Office to track postage used by every company, department, employee, etc. Other software programs may also be configured to access the E-STAMP program so that spread sheets and/or graphs may be produced providing statistics on postage use within a business.

In addition, the E-STAMP program can be used to encode a variety of information within the postage meter stamp using symbol technology. Such information would be machine readable and can be used to identify meter stamp forgeries. The E-STAMP program may also encode a variety of information into a bar code that is printed separately from the postage meter stamp. For example, the E-STAMP could automatically produce ZIP+4 coding and print the appropriate PostNet bar code on the envelope. Currently, a customer who prints the appropriate PostNet bar code on letters only has to pay 29.5¢ per meter stamp rather than 32¢ per stamp. Thus use of the E-STAMP program is not only more convenient than a conventional postage meter but it can also save the user money on postage.

In an alternative embodiment of the present invention, the E-STAMP program is able to automatically calculate the correct postage to place on a letter, parcel or label as a function of the class, zone and weight of the particular item to be mailed. One embodiment of the present invention includes a balance coupled to the processor-based system so that mail can be placed on the balance and the weight of the mail automatically entered into the E-STAMP program for calculating the correct postage for that mail.

In this application there is referred to the situation where it is said that postage (or postage values) are stored in a memory, or where postage values are refilled in a portable memory. Often there is reference to the situation where postage, or postage values, are removed from, or obtained from a portable memory. Of course, what is being referred to is the storage of data values which represent values of postage indicia. During the postage printing operation the amount of postage indicia that the printing system will be allowed to print is controlled by the "values" of the data stored in the portable memory at the time the printing operation is performed. There is no actual transfer of values as such, but rather a matching of data to see that the stored amount is equal to or more than the requested amount to be printed. This is but one step in the verification process.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 1A illustrates a processor-based system for implementation of the present invention;

FIG. 1B illustrates several embodiments of the postage storage device;

FIG. 3 illustrates an embodiment of a user registration form;

FIG. 6 illustrates a preferred embodiment of the security techniques utilized within the present invention;

FIG. 7 illustrates a flow diagram of the operation of the present invention within a processor-based system;

FIGS. 14A and 14B illustrate a flow diagram for controlling the removal of printed data from memory;

DETAILED DESCRIPTION OF THE INVENTION

Figure 2:
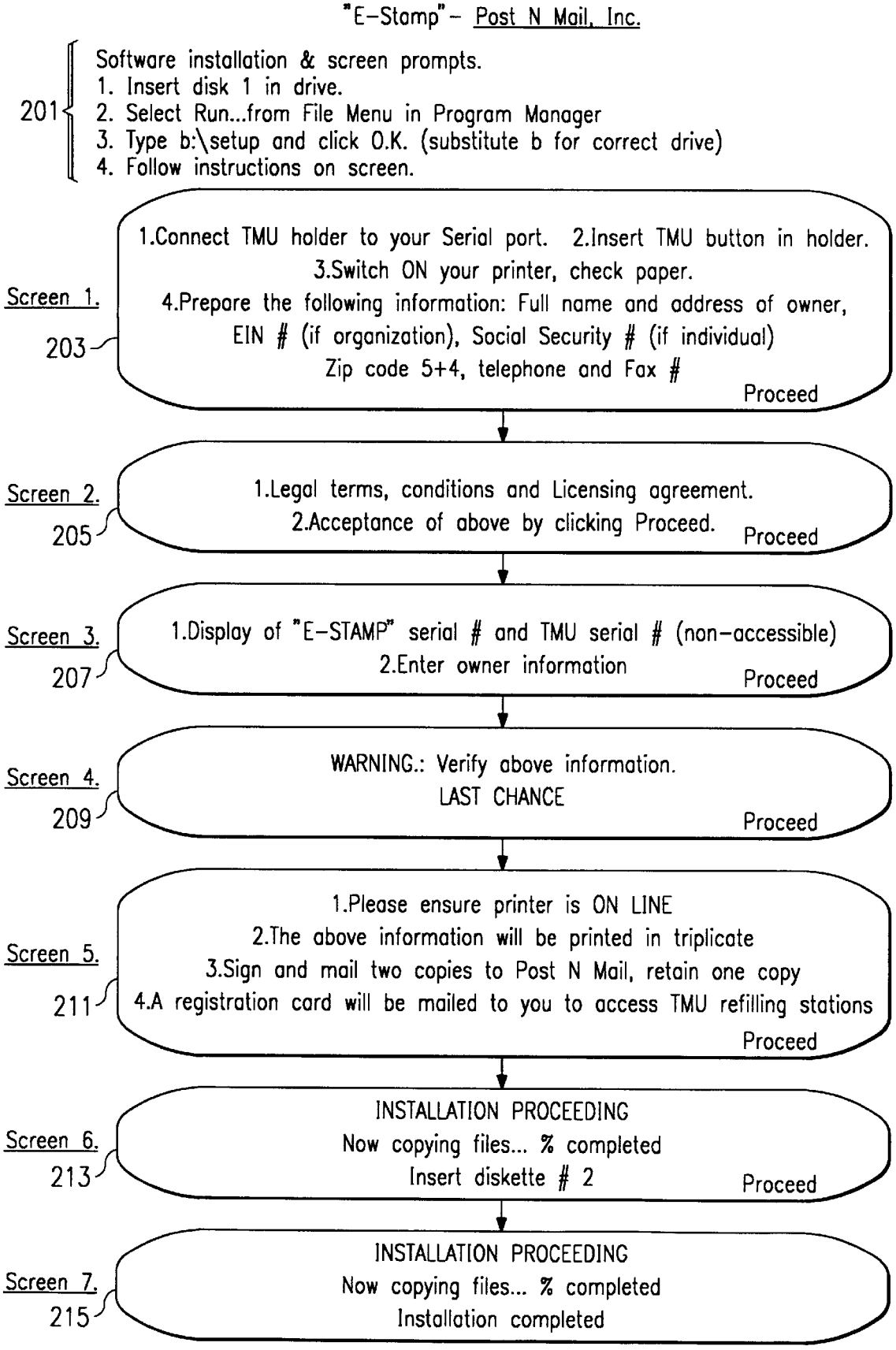
FIG. 2 illustrates an embodiment of user instructions and screen prompts utilized by the present invention to interface with a user when installing the program on the processor-based system for implementation of the present invention.

The present invention provides for a portable postage storage device, described in more detail below, that can be coupled to a processor-based system at both the customer's site and at the U.S. Post Office. Throughout the remainder of this description, reference is made to the U.S. Post Office. Note, however, that the present invention may be implemented within any country and with respect to any postal system.

The present invention will allow an individual to purchase a desired amount of postage at a U.S. Post Office, such postage being stored within a postage storage device. The user may then invoke a processor-based system to access and retrieve a portion of the stored amount of postage via a program stored on a processor-based system, such program hereinafter referred to as the "E-STAMP" program. The E-STAMP program requests input from the user on the weight of the item to be mailed, the addressee's address, etc. The E-STAMP program will utilize the information that was entered to calculate the amount of desired postage for an item to be mailed and print a meter stamp on an envelope, label or letter through a printer or special purpose label maker coupled to the processor-based system.

The postage storage device can also be coupled to a processor-based system located at the U.S. Post Office. Particular Post Office sites will have installed a system complimentary to the E-STAMP system installed on the customer's PC. The program installed at the U.S. Post Office, hereinafter referred to as the "POSTAGEMAKER" will allow a postal worker to interface the postage storage device with the processor-base system residing at the Post Office in order to replenish the amount of postage programmed within the postage storage device in an amount requested and purchased by the customer.

Copending patent application entitled "SYSTEM AND METHOD OF CONTROLLING THE DISPENSING OF AN AUTHENTICATED INDICIA," filed Aug. 16, 1995, Ser. No. 08/516,010 (Attorney Docket No. P00CP2) and patent application entitled "SYSTEM AND METHOD FOR CONTROLLING THE STORAGE OF DATA WITHIN A PORTABLE MEMORY" filed Aug. 16, 1995, Ser. No. 08/515,988 (Attorney Docket No. P00CP3), both of which are hereby incorporated by reference, and are representative of the type of system which would be the best mode for use of this invention.

Referring to FIG. 1A, there is illustrated a processor-based system 10 utilized for implementing the present invention, specifically the aforementioned E-STAMP and POSTAGEMAKER programs. System 10 includes chassis 11 enclosing processor ("CPU") 12 and disk drive 14. System 10 is a general purpose computer, such as an IBM compatible (or Apple MacIntosh) controlled by any general purpose operating system such as DOS or UNIX. Coupled to CPU 12 is display 13, keyboard 15 and mouse 16. Furthermore, system 10 is adapted for coupling with a postage storage device 18, such as the preferred embodiment touch memory utility ("TMU") button 182 illustrated in FIG. 1B. Postage storage device 18 is coupled to the processor-based system 10 through a postage storage device receptor 17.

The postage storage device may be any memory device having some residual data capability, where that memory device can provide sufficient security measures to efficiently limit access to the memory of the device to authorized users. For example, since algorithms can be used to control access to the memory device, a standard "diskette" can be used if desired.

Postage storage devices 18 may be initially assigned to a user when he acquires a copy of the E-STAMP program, or disposable devices, such as TMU buttons 182, may be preloaded in various denominations and meter stamp indicia and sold either over the counter or in existing stamp machines at Post Office locations. The Post Office may also select to sell pre-loaded postage storage devices 18, on which the customer pays a deposit, that can be exchanged for another postage storage device 18 or returned for the deposit whenever postal storage device 18 is depleted of postage. All postal locations may sell pre-loaded postal storage devices 18 or the Post Office may elect to designate particular postal locations for selling such devices.

The Post Office may also sell disposable postal storage devices 18 through machines in the Post Office lobby or in various locations. The postal machine may sell postal storage devices of different denominations and that have been loaded with postage meter stamps of different designs, such that when the postal storage device 18 is coupled to the E-STAMP program that a specific design of a postage meter stamp will be printed on a letter, envelope, or label.

The preferred embodiment, TMU button 182, incorporates a small disk having a memory. TMU button 182 is a small, light-weight, portable, essentially non-breakable device available from Dallas Semiconductor, Dallas, Tex. A TMU button 182 may be coupled to processor-based system 10 through button holder 172. In a preferred embodiment of the present invention, a batch of TMU buttons will be manufactured with specifically designated serial numbers for use solely with the present invention.

An advantage of the preferred embodiment (the TMU button 182) is that a TMU button 182 is small enough and light enough that several may be carried in one hand. Furthermore, the TMU button 182 is sufficiently durable to be sent through interoffice mail. The fact that the portable memory is universally usable with any PC equipped with a button holder 172 allows the per unit cost of TMU buttons 182 to be lower.

Additional alternative embodiments of the postage storage device 18 are illustrated in FIG. 1B. One alternative postage storage device 18 is a smart disk 188 incorporating its own electronic modules capable of read/write operations. One embodiment of such a smart disk 188, Smart Disk™, can be obtained from Smart Disk Security Corporation, Naples, Fla. The Smart Disk™ looks like a floppy disk and fits into a typical PC's floppy disk drive, such as disk drive 178, connected either externally or internally to processor-based system 10; however, Smart Disk™ has its own microprocessor that provides secure, password protected storage. One advantage of the Smart Disk™ is that it can operate in a standard PC disk drive without modification to the disk drive or PC. Smart Disk™ provides security for stored postage with an encrypted password and the encryption algorithm.

Another type of postage storage device 18 is a smart card 186, a plastic card embedded with a microchip. The microchip contains mathematical formulas that encrypt computer data to secure access to that data (i.e., postage) and verify a user's identity before allowing access to the data. One drawback in the currently available smart cards 186 is that they require an expensive interface, such as smart cart interface 176.

Still another type of postage storage device 18 is a PCMCIA card 184. PCMCIA cards are currently used on notebook computers for modular storage and communication. Both external and internal add-on hardware 174 (i.e., card slots) are available for PCs.

The portable memory can contain data fields with specific information, such as passwords, stored therein at particular locations. The portable memory could also contain, for example, a timer, a counter, a graphics program, a bar code program, or any one of a plurality of other "active" elements such as microprocessors, counters, number generators, or coprocessors which can be incorporated into the operation of the system.

The postal storage device 18 may be used on a variety of processor-based systems 10. Processor-based systems 10 may be located in an individual's home, at any business location, or may even be present in a Post Office lobby for after hour usage. In a preferred embodiment, system 10 is an IBM compatible PC. In an alternative embodiment, system 10 could be part of a main-frame computer or system 10 could be part of a network system.

Typically, a user will buy a postage storage device 18, containing a small quantity of postage, with a copy of the E-STAMP program. The user will then install the E-STAMP program on the user's processor-based system 10. FIG. 2 illustrates one embodiment of user instructions and screen prompts to be followed by the user during the installation of the E-STAMP program. The instructions and screen prompts illustrated in FIG. 2 reflect the installation of the E-STAMP program in a "windows" operating environment on a PC equipped with a TMU button 182 and button holder 172. Of course, other means could be employed for implementing the present invention within a processor-based system 10.

The user installation instructions 201 inform the user how to pull up the E-STAMP installation program. Once the installation program is initiated, screen 203 will appear. Screen 203 instructs the user to connect the TMU holder 172 to a serial or parallel port and to insert the TMU button 182 into the holder 172. The user is then instructed to turn on a printer 19 that has been coupled to the processor-based system 10 and check to see that the printer 19 is supplied with paper. Screen 203 further requests that the user prepare the following information: the user's full name and address, an identification number for the user (i.e., an employer identification number (EIN#), if the user is a business or organization; or a social security number (SS#), if the user is an individual), the user's zip code, the user's telephone number and the user's fax number.

The next screen, screen 205 displays the Post N Mail License Agreement with its legal terms and conditions. Acceptance of the terms and conditions set out in the license agreement is indicated when the user continues with the installation program.

Next, screen 207 will appear and display the E-STAMP serial number and TMU serial number. At this time the user-specific information requested in screen 203 should be entered into the E-STAMP program. Once the user has entered the user-specific information, screen 209 will appear warning the user to carefully verify the correctness of the entered information.

After verifying the information added into the E-STAMP program, screen 211 will remind the user to ensure that a coupled printer 19 is on line. The user information entered into the E-STAMP program will then be incorporated into a user registration form, one embodiment of which is illustrated in FIG. 3. The E-STAMP registration form will be printed in triplicate. The user is instructed to sign and mail two copies of the registration form to the creator of the E-STAMP program, Post N Mail, Inc. and to retain one copy of the registration form. Screen 211 also informs the user that a registration card will be mailed to the user in order that the user may access TMU refilling stations.

The E-STAMP installation program continues with screen 213, which describes the progress being made in installing the E-STAMP program, and screen 215, which informs the user when the E-STAMP program installation has been completed.

Referring to FIG. 3, there is illustrated a preferred embodiment of the E-STAMP registration form. The registration form includes information such as the TMU button serial number 31, the E-STAMP serial number 32, the date and time that the E-STAMP program was installed 33, and user-specific information 35 (e.g., name, address, telephone and fax numbers, and identification number), and a copy of the Post N Mail License Agreement 38 having an identified location for the user to sign. A preferred embodiment of the E-STAMP registration form will also contain all of the information needed to specifically identify the TMU button 182, E-STAMP program, and registered user in an encrypted format 37. The encrypted information 37 will be in a machine-readable graphical security interface such as a standard bar code.

The standard bar code contains white and dark areas in the form of bars that can be read by a laser scanner. The laser scanner illuminates the white and dark areas with a light of a certain frequency. The light is reflected back to the laser scanner in such a way as to indicate the pattern of white and black areas within the bar code. Since white areas reflect much more light than dark areas do, a perpendicular scan of the bar code will allow the scanner to translate the reflected light into the coded information. More than 20 linear bar code languages have been developed, each with its own specifications for how many bars and spaces make up a character, how characters are to be arranged, whether the characters can be letters as well as numbers, and so forth. The most widely-used bar code is the Universal Product Code (UPC) seen on everyday grocery items. The standard bar code currently used by the Post Office is POSTNET ZIP+4 described in Postal Service Publication number 67.

More sophisticated graphical security interfaces have been developed over the last decade, such as Intermec Corporations' Code 49 and Laserlight System Inc.'s Code 16K. A major advantage of these more sophisticated graphical security interfaces is that they contain an error-correction formula which can often recover the entire message even if parts of the code have been torn or damaged.

A preferred embodiment of encrypted information 37 is a graphical security interface developed by Symbol Technologies of Bohemia, N.Y. and is called PDF417, a portable data file. PDF417 is a graphical security interface constructed from data units called "words," each of which is 17 modules long. Bars are made from filling in up to six consecutive modules and each unit has four separate bars and four spaces. In essence, PDF417 can stack the equivalent of up to 90 one-dimensional bar codes, each just three hundredths of an inch high. Thus, the PDF417 symbology is more complicated to produce and scan than is the typical one-dimensional bar code and allows for a denser coding of information. Because the PDF417 symbology specification includes sophisticated protocols for error-correction, the actual density of information is highly variable, but can be ten times the amount of information found in U.S.P.S. PostNet bar code, per square inch. PDF417 is available from Symbol Technologies, Inc., 116 Wilbur Place, Bohemia, N.Y. 11716 and the operation of the PDF417 is detailed in PDF Primer obtained from Symbol Technologies, Inc. and is hereby incorporated herein by reference.

When Post N Mail, Inc. receives the signed Post N Mail License Agreement from the user, the encrypted information 37 can be scanned with a laser scanner so that the information contained therein can be automatically transferred to a registered user's database. When the encrypted information 37 has been transferred to the registered user's database, a registration card containing a Post N Mail (PNM) serial number will be printed and mailed to the registered user.

The user may then take that registration card with the user's TMU button 182, or other postage storage device 18, to the Post Office to be registered with the Post Office. Until the TMU button 182 has been registered with the Post Office, the POSTAGEMAKER program will not recognize TMU button 182 as being an authorized postage storage device 18.

To register a TMU button 182, or other postage storage device 18, a postal worker must enter the information on the PNM registration card into the POSTAGEMAKER program. Such information will include the PNM serial number, EIN# number or SS#, TMU button serial number, and the address and telephone number of the registered user. Once all of this information has been entered into the system, the POSTAGEMAKER program will then recognize TMU button 182 and allow a postal worker to replenish the amount of postage stored within button 182 at the request of the user in a manner to be discussed below.

System 10 may be utilized at a customer site for permitting a user to retrieve postage stored within postage storage device 18, via the E-STAMP program, for subsequent printing as a postage meter stamp onto a piece of mail through printer 19, coupled to system 10. The utilization of the E-STAMP program by a customer will be further described below.

Alternatively, a pair of systems 10 may be linked together through Public Switched Network ("PSN") 102 via modem 101 or directly through digital telecommunications trunks (not shown). Processor based systems 10 located at different U.S. Post Offices may be linked via PSN 102 in a conventional well known manner (such as through modem 101) so that information may be shared between the various Post Offices. Generally, a copy of the POSTAGEMAKER program will be stored within at least one processor-based system at selected U.S. Post Office locations. PSN linkage of processor-based systems 10 by the Post Office and the customer, or user, will allow the sharing of information between the various Post Offices and will allow a customer to call a number (an authorized Post Office number) and have the Post Office transfer the required amount of postage to a postage storage device 18 installed at a customer site by modem.

The process for validating the postage storage device 18 using the Post Office POSTAGEMAKER program is described in the above-identified co-pending patent application (Attorney Docket No. P004) entitled System and Method for "Printing Personalized Postage Indicia on Greeting Cards".

Figure 4A:
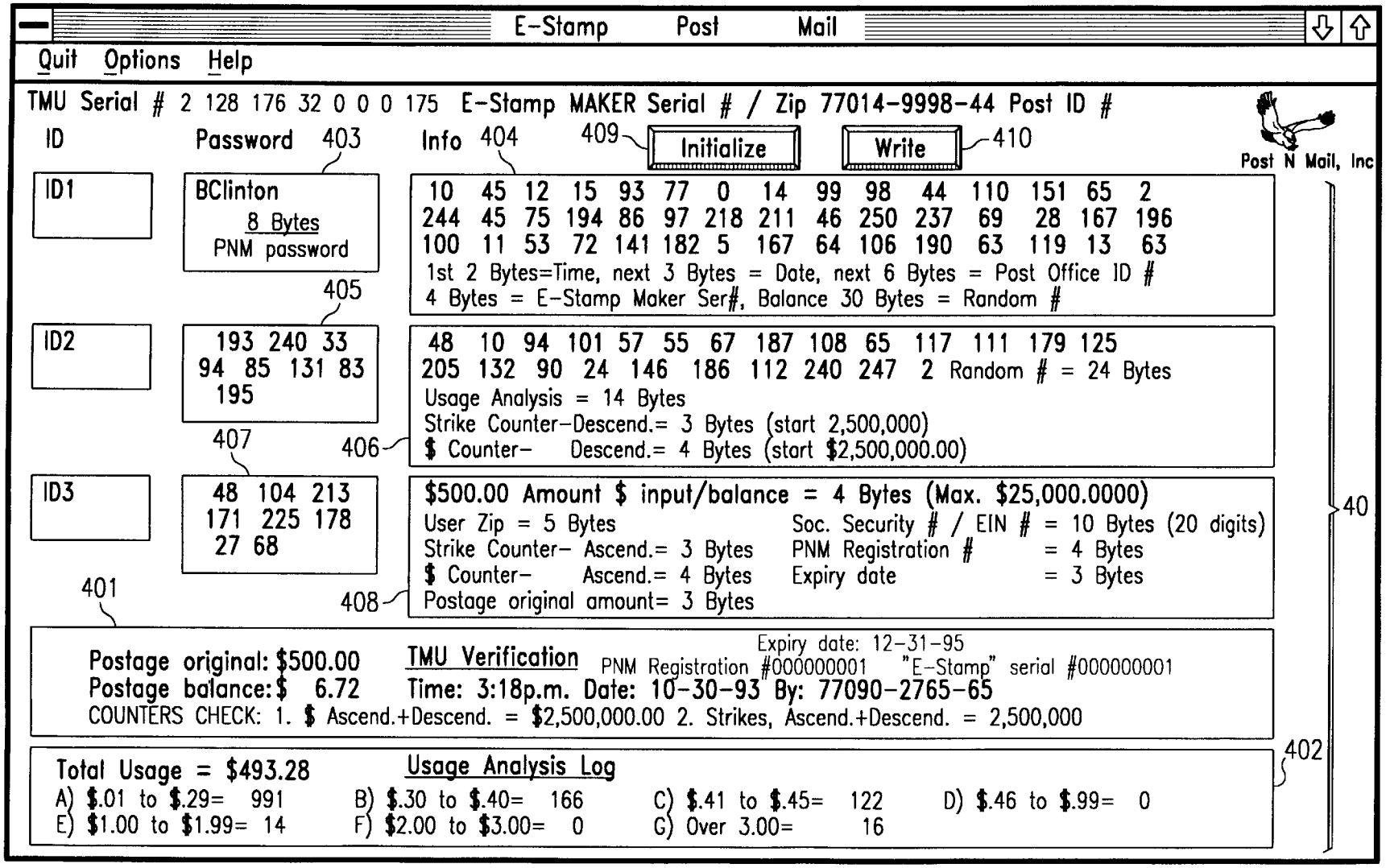
FIGS. 4A–4B illustrate a display screen utilized by the present invention to interface with a U.S. Post Office employee when replenishing postage within the present invention.

Referring to FIG. 4A, there is illustrated a preferred embodiment of a display screen shown on display 13 to a U.S. Post Office employee when accessing the present invention on system 10. Of course, the particular display aspects illustrated in FIG. 4A may be modified in any one of numerous ways. Also, in a preferred embodiment of the present invention, processor-based system 10 will provide for input from a user via keyboard 15 and mouse 16. However, other various forms of input available to processor-based systems may be utilized, such as a light pen or a touch-sensitive screen (both not shown).

At the upper right-hand corner of display screen 40, there is indicated a POSTAGEMAKER serial number, in this example "77014-9998-44." This serial number may include the zip code of the Post Office location, or may be selected at random. This serial number may also include a designation of a particular system 10 or a designation of the postal employee performing the transaction.

In the upper left-hand corner of display screen 40 is illustrated a TMU serial number, in this example "2 128 176 32 0 0 0 175." This serial number represents eight bytes of information stored within TMU button 182, each byte may represent any number from 0 to 255. A TMU serial number is specifically assigned to and will identify a specific TMU button 182. Thus, display screen 40 indicates that the postal employee has coupled an authorized TMU button 182 to a processor-based system 10 which incorporates the POSTAGEMAKER program.

The use of the POSTAGEMAKER program in conjunction with a database program will allow the Post Office to generate records indicating all E-STAMP authorized postage by Post Office location (or zip code), Post Office employee, TMU serial number, etc. This type of information can be easily compiled to determine Post Office sales, market forecasts, etc.

Typically, the first two numerals (bytes) within the TMU serial number are assigned by the button (or memory) manufacturer. The third byte is selected by the U.S. Postal System and identifies TMU buttons 182 specifically designed for the POSTAGEMAKER program, excluding other TMU buttons 182 not designed for the POSTAGEMAKER program, such as disposable buttons, and assisting in the exclusion of any other means for accessing the POSTAGEMAKER program. As a result, the present invention may be designed so that only authorized TMU buttons 182 may access the POSTAGEMAKER program for replenishment of postage as will be discussed below.

The remainder of the TMU serial number is basically the sequential serial number of that particular TMU button 182 in particular.

As the POSTAGEMAKER program reads the information stored within TMU button 182, the TMU serial number and the information in blocks 401 and 402 are displayed on display 13. The "TMU Verification" information in block 401 shows the date and Post Office location where the last addition of postage was electronically stored within button 182. As shown within box 401 of FIG. 4A, coupled TMU button 182 currently contains a postage balance of $6.72, which is most likely a portion of the postage that was input into button 182 at 3:18 p.m. on Oct. 30, 1993, at the Post Office having an ID number of "77090-2765-65." It may be observed that this serial number is different from the POSTAGEMAKER serial number shown at the upper right-hand corner of display screen 40, indicating that these numbers represent two different Post Office locations, and that button 182 was formerly coupled to a processor-based system 10 at Post Office "77090-2765-65" but is currently coupled to a processor-based system 10 residing at Post Office "77014-9998-44".

Box 401 also shows the expiration date of button 182, the user's PNM registration number, the user's E-STAMP serial number, and a strike and dollar counter check as will be described in more detail below.

Box 402 is also displayed on screen 10 and itemizes the quantity of postage of designated values that has been used and subtracted from the postage stored in button 182. For example, box 401 of FIG. 4A shows that $500.00 worth of postage was initially added to button 182 and that $6.72 worth of postage remains in button 182. This means that $493.28 worth of postage has been deducted from button 182. Box 402 of FIG. 4A shows that postage valued from $0.01 to $0.29 was subtracted from the amount of stored postage 991 times, that postage valued from $0.30–$0.40 was subtracted 166 times, that postage valued from $0.41–$0.45 was subtracted 122 times, that postage valued at $1.00–$1.99 was subtracted 14 times and that postage valued at more than $3.00 was subtracted 16 times.

In a manner to be discussed in detail below with respect to FIG. 5, the first password (i.e., BCLINTON) is entered into the POSTAGEMAKER software in box 403. That password will be used to generate other passwords as described below and checked against the information stored in button 182. If the Post Office requests it, an extra password can be included to access and start the POSTAGEMAKER program. When the correct password for button 182 is entered into POSTAGEMAKER (i.e., BClinton), a string of numerals are generated as shown in block 404. In a preferred embodiment of the present invention, the first several numerals within block 404 represent the current time and date. A second string of numerals represent the POSTAGEMAKER serial number and the Post Office identification number. The remainder of the 45 bytes are generated randomly by the POSTAGEMAKER program. This generation of random numbers is detailed below.

Thereafter, a second password is generated from the numbers within block 404 through the application of an algorithm, an example of a second password is illustrated in block 405. These numbers are used as a second password to assist in the random generation of numerals within block 406.

In a preferred embodiment of the present invention, fourteen of the 45 bytes or numerals within block 406 represent a button usage analysis (i.e., how much of what value of postage has been used); three numerals (bytes) represent the number of strikes (or uses) that have been made and subtracted from a starting point of 2,500,000; and four numerals (bytes) represent the dollar value of postage used and subtracted from a starting point of $2,500,000. The remainder of the numerals are generated randomly by the POSTAGEMAKER program.

Thereafter, another algorithm utilizes the numerals generated within block 406 to derive the third password displayed within block 407. If all is correct, the cursor will then stop within block 408 so that the postal employee may enter a desired amount of postage in U.S. dollars as requested by the user owning TMU button 182 currently coupled to the POSTAGEMAKER program. In a preferred embodiment of the present invention, four bytes represent the amount of postage entered by the postal worker, ten bytes represent user-specific information, five bytes represent the user's zip code, three bytes represent the original postage amount, three bytes represent the number of strikes (or times that the postal storage device has been accessed), four bytes represent the accumulated value of postage taken from the postage storage device, and three bytes represent the expiration date of button 182. Button 182 may be programmed to expire at any time desired by the Post Office. The Post Office may desire that postage storage devices 18 expire every six months in order to maintain a valid registration with updated information.

None of the numbers described above, or the passwords generated therefrom, are displayed on the screen. However, POSTAGEMAKER utilizes information from button 182 to generate numerals in blocks 406 and 408 to generate the usage analysis log illustrated in block 402 and to perform a counters check illustrated in block 401. The counters check adds the number of strikes subtracted from 2,500,000 (see block 406; descending strike counter) to the number of strikes made (see block 408; ascending strike counter). If these numbers are accurate, their sum should equal 2,500,000. A similar dollar counter check is also performed. The TMU button 182 is initialized to recognize 2,500,000 strikes and $2,500,000 worth of postage. Whenever a user has used 2,500,000 strikes or used $2,500,000 worth of postage, the postage storage device must be returned to the Post Office, or exchanged for a new one.

As shown in block 408, the user has desired to add $500.00 worth of postage to TMU button 182. This amount has been entered by the employee. Subsequent to entering the $500.00 amount, the postal employee will press button 409 to initialize the system. An optional aspect of the initialization process would be to allow a customer to select one or more graphic configurations of postage indicia to be input into TMU button 182. The postage indicia may include standard indicia and/or a number of designs such as those on the commemorative stamps printed by the Post Office. A customer may select a button with one design, or several designs.

The postage storage device 18 may be programmed with instructions to be read by the E-STAMP program. For example, if more than one graphical configuration of a postage indicia has been stored in the postage storage device then the E-STAMP may be instructed to display each of those graphical configurations to the consumer and allow the consumer to select the one that they want printed on their mail. In addition, the postage storage device may also be programmed to select a particular postage indicia only within a particular time period. For example, a "Valentine's Day" postage indicia may be programmed to be printed only on or before February 14th and not afterward.

Once the appropriate amount of postage and the desired postage indicia has been selected, the postal employee may press button 410 to "write" the $500.00 amount into TMU button 182 coupled to system 10.

Alternatively, a user may maintain an account with the Post Office or a credit card account which will be automatically charged for postal charges printed using TMU button 182. In this situation, a set money value will not be entered into TMU button 182, but rather an authorization to debit a particular account will be entered into TMU button 182.

Figure 4B:
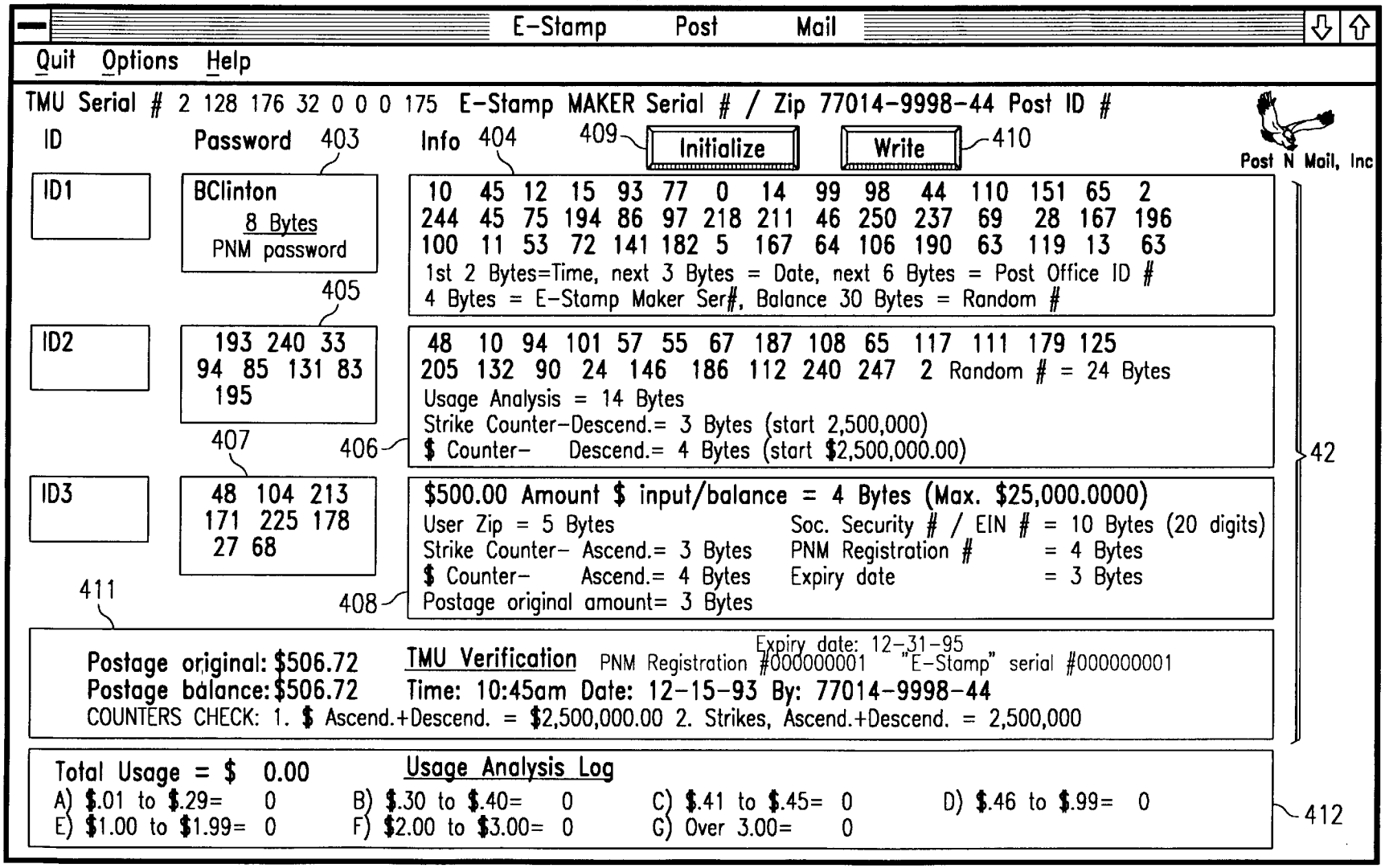

Immediately thereafter, display screen 42, illustrated in FIG. 4B, is shown to the postal employee. Display screen 42 is similar to display screen 40 except for the new information within block 411 which now shows that TMU button 182 contains $506.72 worth of postage, which was updated at 10:45 a.m. on Dec. 15, 1993 by the POSTAGEMAKER program located at Post Office location "77014-9998-44." Note that in this embodiment the postage original (block 411) and usage analysis log (block 412) are re-zeroed whenever new postage is added to TMU button 182.

Figure 5:
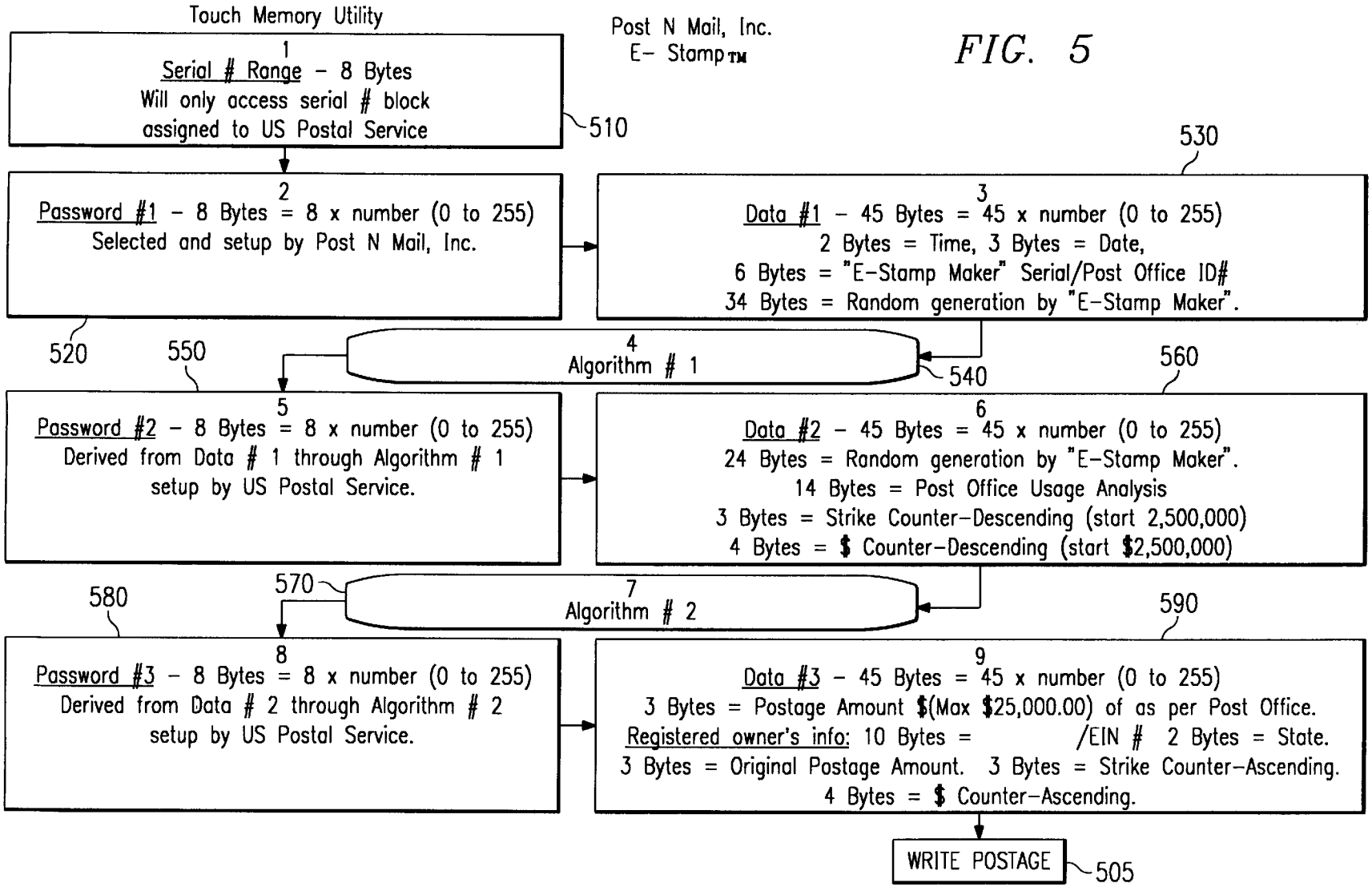
FIG. 5 illustrates a flow diagram of the replenishing process.

Referring next to FIG. 5, there is illustrated a flow diagram of the aforementioned method of providing security within the present invention. First, in block 510, the TMU serial number is accessed by the security program within the present invention. If the TMU serial number is not one specifically assigned to the U.S. Postal Service, the process will not proceed to step 520. In step 520, the program will write a password provided by the creator of the program. Thereafter, at step 530, the aforementioned data is produced and displayed within block 404. The random numerals will be produced as a function of the entered password.

Thereafter, in step 540, a first algorithm selected by the U.S. Postal Service will operate on the data within block 404 to produce a second password (step 550). This second password, displayed within block 405, is used within step 560 to generate a second set of data (the numerals displayed within block 406). A second algorithm within step 570, utilizes the second set of data to produce a third password (step 580). Once the above is written on the TMU button 182, the Post Office employee will be able to store postage to TMU button 182 by adding the desired amount within block 408 (step 590). Thereafter at step 505, write button 410 is "depressed" to thereby store postage within TMU button 182.

Referring next to FIG. 6, there is illustrated the algorithm used within the present invention, and described with respect to FIG. 5. Note that the TMU serial number may be incorporated into the algorithm(s) to make each TMU button unique. For a given 8-byte password, "p1" represents the first byte of that password. For a given 45-byte data area, "d1" represents the first byte of that data. The "mod operator" stands for the modulus, or remainder, of a division.

Once the required amount of postage has been transferred to the TMU button 182 the user may then physically carry the button back to the user's business location and couple TMU button 182 to a processor-based system 10 through button holder 172.

Before data within the postage storage device 18 can be accessed and used by the customer, the postage storage device 18 must be validated by the E-STAMP program.

Upon validation of the postage storage device by the E-STAMP program, the customer's processor-based system 10 can access the postal amount stored in TMU button 182 and down-load portions of the stored postage to the E-STAMP program to be used for printing postage meter stamps on pieces of mail.

Referring next to FIG. 7, there is illustrated a flow diagram of the process employed within processor-based system 10 configured for allowing a user to print a postage meter stamp.

Figure 8:
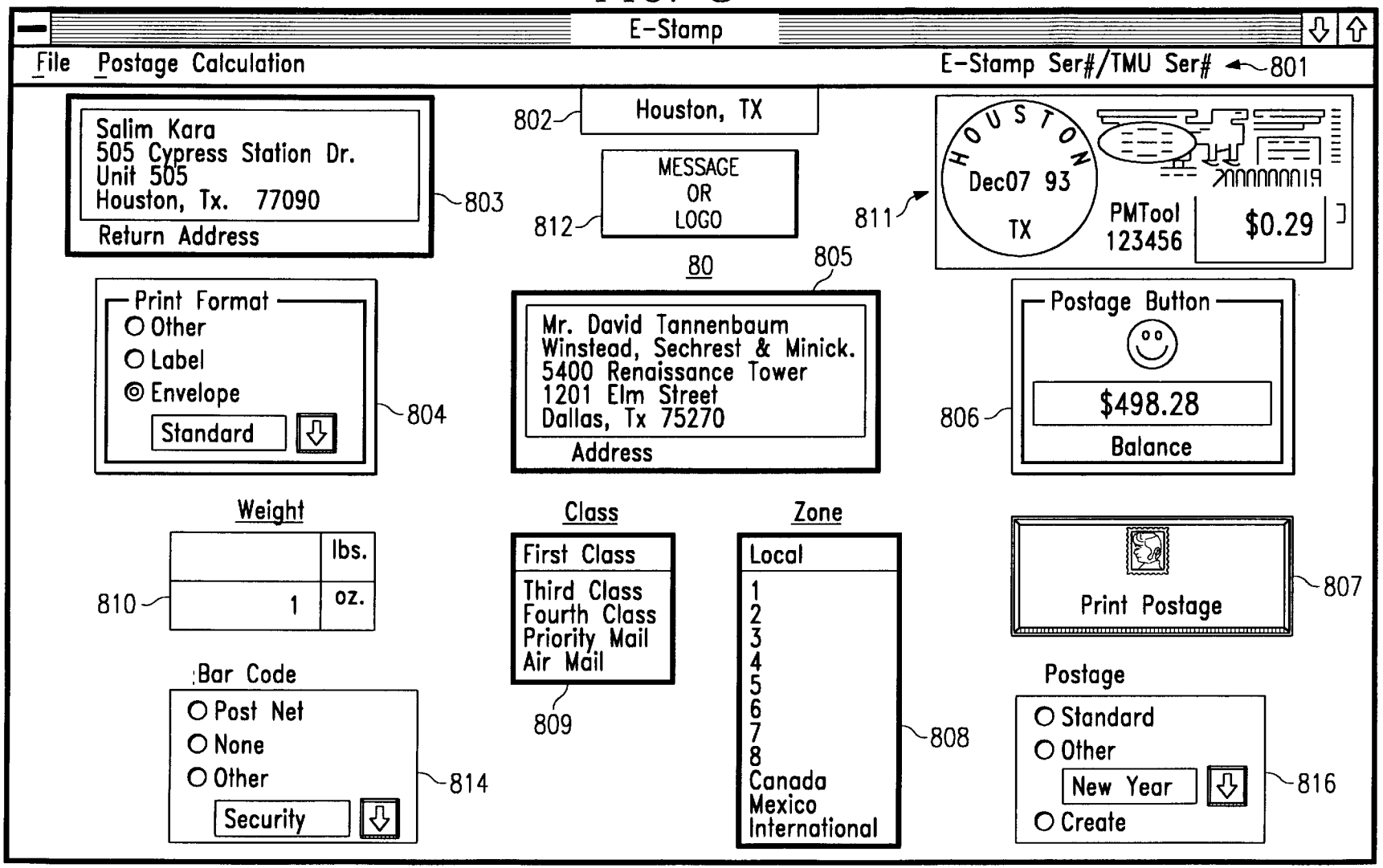
FIG. 8 illustrates a display interface provided to a user when accessing the present invention on a processor-based system.

As previously discussed, the E-STAMP program may be a stand alone program, or it may be associated and coupled with other programs, as for example a word processor or graphics program. Therefore, the E-STAMP program may be started directly (step 702) or through a word processor program also residing on the processor-based system 10 (step 701). Thereafter, at step 703, the E-STAMP program shows display 80, illustrated and described with respect to FIG. 8, to the user.

Next, in step 704, as shown in FIG. 7, the E-STAMP program verifies the TMU serial number associated with TMU button 182 coupled to processor-based system 10. If TMU button 182 has not been inserted within its holder 172, at step 705, a message is flashed to the user to insert TMU button 182. If the wrong TMU button, or a TMU button not programmed for use with the E-STAMP program, has been inserted and coupled to system 10, a warning is flashed to the user to insert an authorized, or valid, TMU button 182 as illustrated in box 706. The process of TMU verification represented by box 704 includes several steps as follows:

Step 1—Serial number is verified.

Step 2—E-STAMP will match its Password 1 (BCLINTON) with the TMU's Password 1. If ok, Step 3—E-STAMP will read information in Data 1 (block 530) and process it through algorithm 1.

Step 4—If the results of step 3 match Password 2, E-STAMP will proceed to Data 2 (block 560).

Step 5—E-STAMP will read information in Data 2 and process it through algorithm 2.

Step 6—If the results of step 5 match Password 3, E-STAMP will then be able to access Data 3 which contains postage amount and proceed to step 707.

If a valid TMU button is coupled to system 10, at step 707, the information within TMU button 182 is read and the information is verified, for example the ascending and descending counters are added together for verification and the expiry data is verified if the postal balance is greater than $2.01. In addition, the zip code, E-STAMP serial number and user identification number are verified. If all of the information checks out the TMU button's serial number is displayed in conjunction with the E-STAMP serial number in the top right corner of screen 80 (see 801), FIG. 8. The remaining postage balance residing within TMU button 182, is displayed within block 806.

Next, at step 708, return address box 803 is completed automatically or manually. The address within 803 may be automatically entered from the adjoining word processor program, the address may be selected from a drop-down box (not shown), or the address may be manually input. Any entered address may be saved within the E-STAMP program and added to the drop down menu. Additionally, if a return address is not desired, it may be omitted.

Thereafter, in step 709, the contents of address box 805 are entered in a manner similar to the contents of return address 803.

Next, at step 710, the user may select the print format by the use of box 804. As illustrated, the postage meter stamp may be printed on a label through printer/label maker 19, or a choice may be made to print the postage meter stamp on an envelope inserted within printer 19, which may be chosen to be a standard size or a nonstandard size as selected by the user. Note that if the postage meter stamp is to be printed on a label, it may be desired that the return address within 803 and the address within box 805 not be printed.

Figure 9:
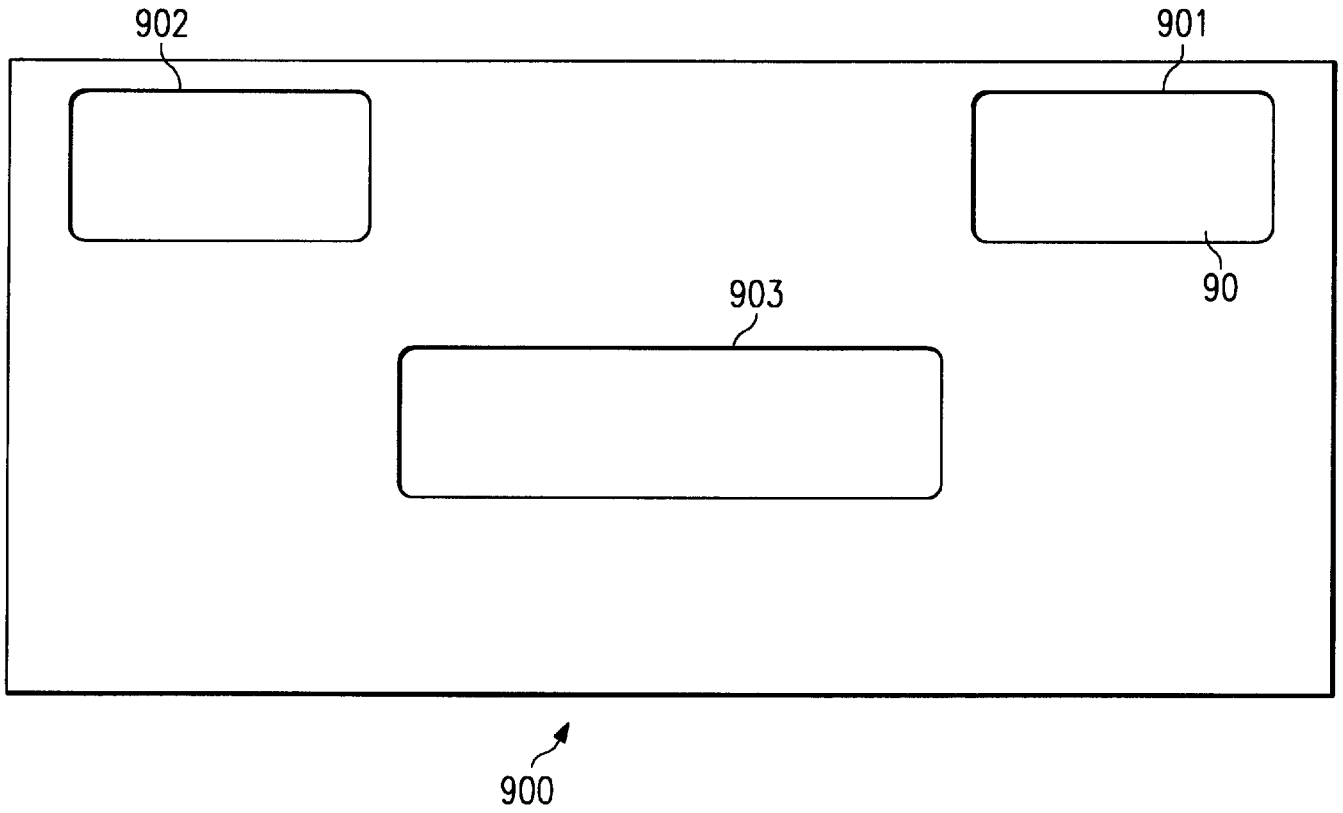
FIG. 9 illustrates an envelope used to display the postage meter stamp printed on a letter.

Alternatively, the postage meter stamp, a bar code, and the addresses within boxes 803 and 805 may all be printed on a flyer, a pamphlet, a postcard or sheet of paper. Whenever the meter stamp is printed on a letter, along with the addresses in boxes 803 and 805, that letter may be folded so that the meter stamp will show through an opening or window 901, in the top right hand corner of a specially designed envelope 900 illustrated in FIG. 9. Envelope 900 may be a standard or non-standard size with any number of windows as designed by the user. Typically, envelope 900 will have a first window 901 in the top right hand corner for the printed postage meter stamp to show through. Envelope 900 may also have other windows for the addressee's name and address (903) and for a return address (902) to show through. Envelop 900 may have glassine paper, or other transparent covering material 904, covering the described windows such that the postage meter stamp and other imprinted information is protected from inadvertent detachment and adverse conditions (such as inclement weather).

Thereafter, in step 711, the user enters the weight of the package or letter associated with the postage meter stamp. This weight may be entered manually, or automatically through the use of scale 103 coupled to processor-based system 10 in a manner well known in the art. The weight of the package or letter will appear in box 810. In step 712, the user selects the class of mail from the choices shown in box 809.

At step 713, the user may select whether or not to print selected data in a bar coded message. The user may select to have all mail imprinted with a standard Post Net Zip+4, as described in Postage Service Publication 67, as shown in box 814. If the user selects Post Net, the E-STAMP program can automatically generate the appropriate Post Net bar code from the addressee's zip code. The Post Office encourages the use of Post Net bar codes, as it allows mail to be automatically sorted for distribution.

The user may also select other types of graphical security interfaces, such as Symbol's Portable Data File Code (the PDF417 symbology) as described above. Using a selected graphical security interface, a user can encrypt a great deal of information into a small space. Graphical security interfaces may also be imported into the E-STAMP program from another application program running on the same processor-based system 10.

In addition, selected information may be incorporated within the meter stamp using a graphical security interface. A preferred embodiment will print the postage meter stamp utilizing Symbol's Portable Data File code (the PDF417 symbology) as described above. An encrypted postal meter stamp may include any combination of the following information: the day, the date, the postage storage device serial number, the E-STAMP serial number, the sender's zip code, the addressee's zip code, the expiration date of the postage storage device, the cumulative values of the strike and dollar counters, PNM registration number, the user's identification number, and the Post Office identification number. The postage meter stamp may contain this encrypted information incorporated within an insignia or design, or it may appear as a background for the postage amount printed in a visually recognized form.

By printing the postal meter stamp with encrypted information within the stamp, the Post Office can scan the postal meter stamp to verify that an item of mail has been posted with authorized postage.

Next, at step 714, the user may select a U.S. postal zone or alternatively elect that the particular piece of mail is to be sent to Canada, Mexico or some other international designation as depicted in box 808. User selection of the international designation in box 808 will result in a drop down menu to allow the user to enter the country of designation and allow the E-STAMP program to automatically calculate the necessary postage.

The E-STAMP program will automatically incorporate the aforementioned entered parameters—weight, class, zone—in order to correctly calculate the correct postage to print in conjunction with the meter stamp and to deduct from the postage amount stored within TMU button 182.

Note that during the selection of the various parameters within display 80, the E-STAMP program may be implemented to update the postage amount displayed within meter display 806 as each parameter is chosen on essentially a real-time basis.

In step 715, the user is provided with box 802 to insert the location from which the mail is to be sent. If no location is entered, the location of the PC with the E-STAMP program coupled to the TMU button 182 is automatically entered into box 802. The location entered into box 802 may be utilized by the E-STAMP program to calculate the correct postage.

The date that the mail is stamped is automatically adjusted every day by the E-STAMP program and will prevent post-dating or pre-dating mail. This information is added within display 811 or may be encrypted within the postage meter stamp as described above.

In step 716, the user is provided with a message box 812 to allow the user to add an optional message or greeting (e.g., "Happy Holidays") to be printed next to the meter stamp. This message may be changed at any time by the user, directly or by a "merge" command in conjunction with a word processing or graphics program coupled to the E-STAMP program.

At step 717, the user may select the configuration of postage indicia desired. Box 816 will allow the user to select a standard postage indicia such as shown in the top right hand corner of screen 80, FIG. 8, or to select another postage indicia. Selection of the "Other" option in Box 816 allows the user to select a postage indicia that has been previously stored within the E-STAMP program or to import a new postage indicia using a "merge" command in conjunction with a word processing or graphics program coupled to the E-STAMP program. Any imported indicia may be saved within the E-STAMP program and added to a drop-down menu. Importation can be from any data base, including the portable memory, a modem and remote memory, or from a data base preloaded in the main processor's memory and operating in cooperation with the CPU. The user may then change, add a new indicia, or otherwise select which indicia is desired for a given piece of mail. The user can use any well-known graphics program for this purpose, including Macromedia's FreeHand_program, which is hereby incorporated by reference herein.

Figure 16:
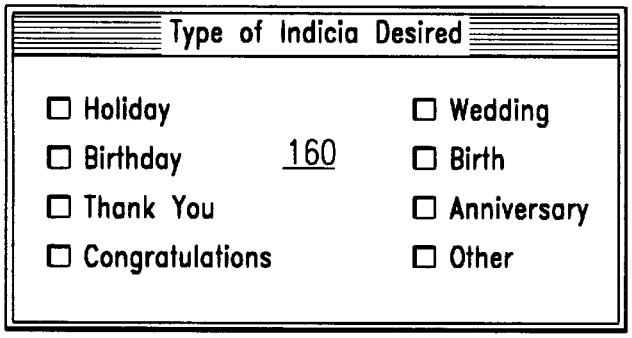
FIG. 16 illustrates one embodiment of a display interface provided to a user for selecting a type of postage indicia.
Figure 17:
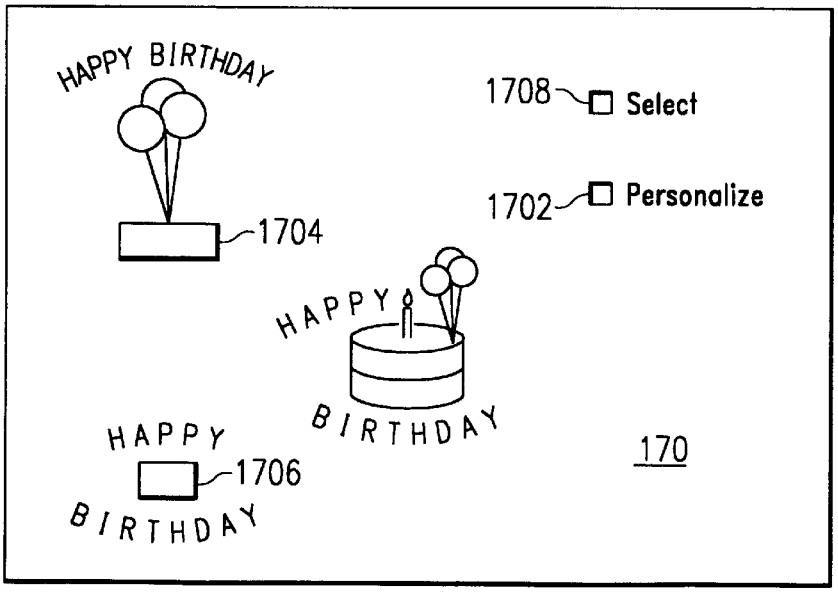
FIG. 17 illustrates one embodiment of a display interface provided to a user for personalizing a selected postage indicia.

As discussed, Box 816 also allows the user to select and create a postage indicia. If the user selects this option, a new screen 160 will appear, such as seen in FIG. 16, giving the user a selection menu for the type of indicia that the user desires to create. Once the user selects a type of indicia, a new screen 170 will appear with at least one sample indicia such as seen in FIG. 17.

In a preferred embodiment, there is more than one sample indicia. The user may click on the desired indicia and then the user has the option of personalizing the indicia by clicking on "Personalize" (box 1702). The indicia may be personalized with information such as the name of the person whose birthday it is (box 1704) and which birthday (38th) that person is celebrating (box 1706). Once an insignia has been created that the user likes, the user clicks on "Select" (box 1708) and the selected indicia will be printed as part of the postage meter stamp on a piece of mail. The E-STAMP user may then choose to add the selected indicia to the E-STAMP program or to delete it.

In step 718, the E-STAMP program utilizes the input/output ports of processor-based system 10 to send to printer/label maker 19, the correct data pertaining to the meter stamp, the postage indicia, the encrypted message, the authorized amount of postage, the return address, the addressee's address, etc. to be printed on an envelope, letter, card or label.

The amount of postage printed on the meter stamp is automatically deducted from the amount stored within TMU button 182. Other information is also automatically updated including the usage record for this particular serial number of TMU button 182 and any other information, such as the addressee, the postage amount, the date, and the original denomination.

The aforementioned steps may be repeated for a subsequent piece of mail, or the user may decouple TMU button 18 from system 10.

The data accumulated by the E-STAMP program on addressee, class of mail, amount of postage, date of posting the mail, etc. can be exported to another application program operating on the same processor-based system as E-STAMP. Such data will allow E-STAMP users like lawyers, accountants, advertising agencies, etc., who bill their clients for postage to keep track of postage expenses on a per client basis.

POSTAGE AND INDICIA UPDATING CONTROL

TMU button 182 includes several memory sections, each section including an ID area, a password area and a data area. Access to a given data area is controlled by a password written into the corresponding password area. As discussed in further detail below, there are at least three different options for programming the memory areas of a given postage storage device 18: master buttons (Level 1) which are provided to a limited number of supervising Post Office personnel; employee buttons (Level 2) which are provided to authorized Post Office employees who perform refill and registration operations on customers' postage buttons; and postage buttons (Level 3) which allow the customer (user) to print an authorized amount of postage indicia using a separate system controlled by the user.

Figure 10A:
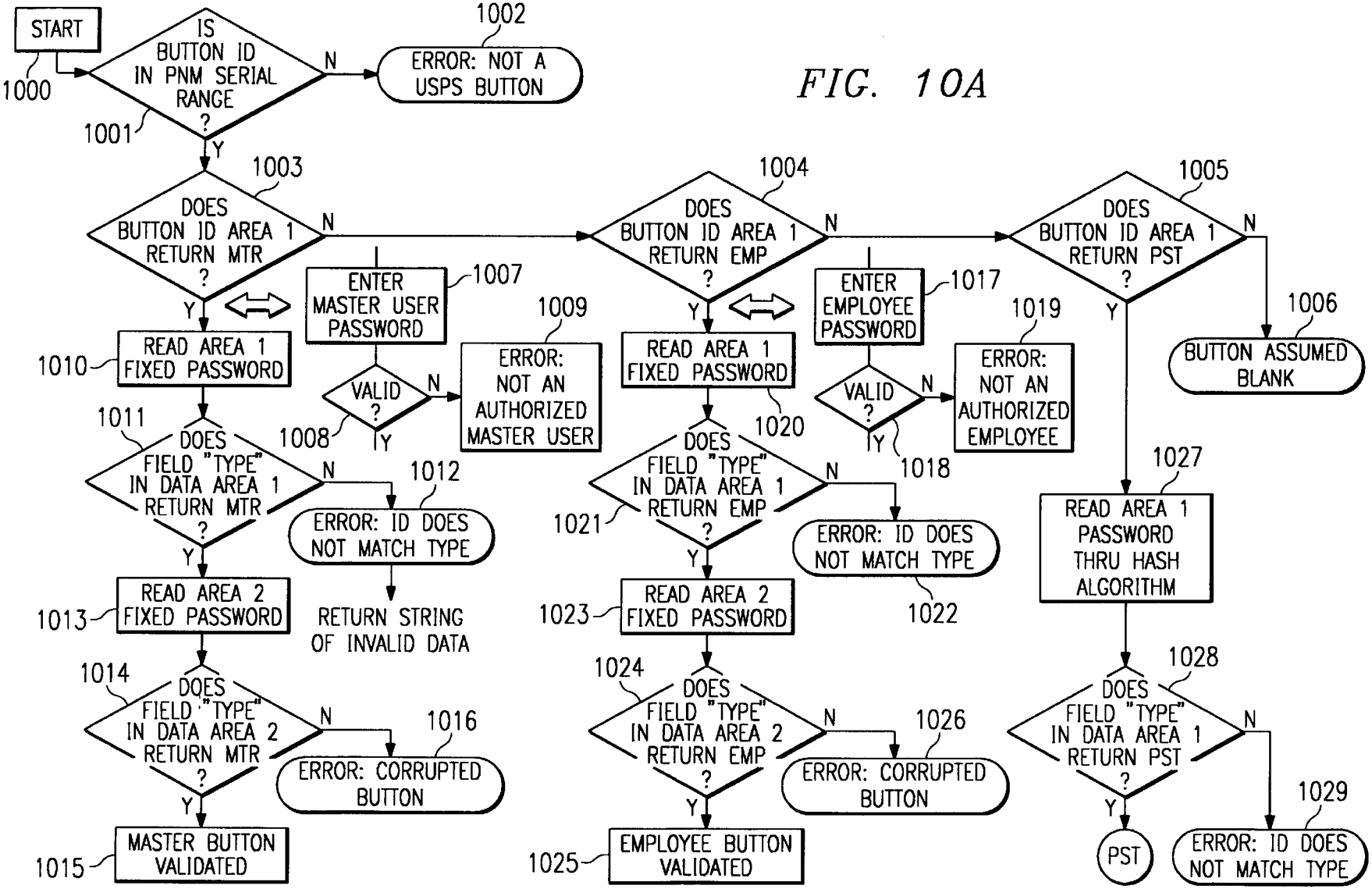
FIGS. 10-A, 10B and 10C illustrate how the master, employee and postage buttons are validated.
Figure 10B:
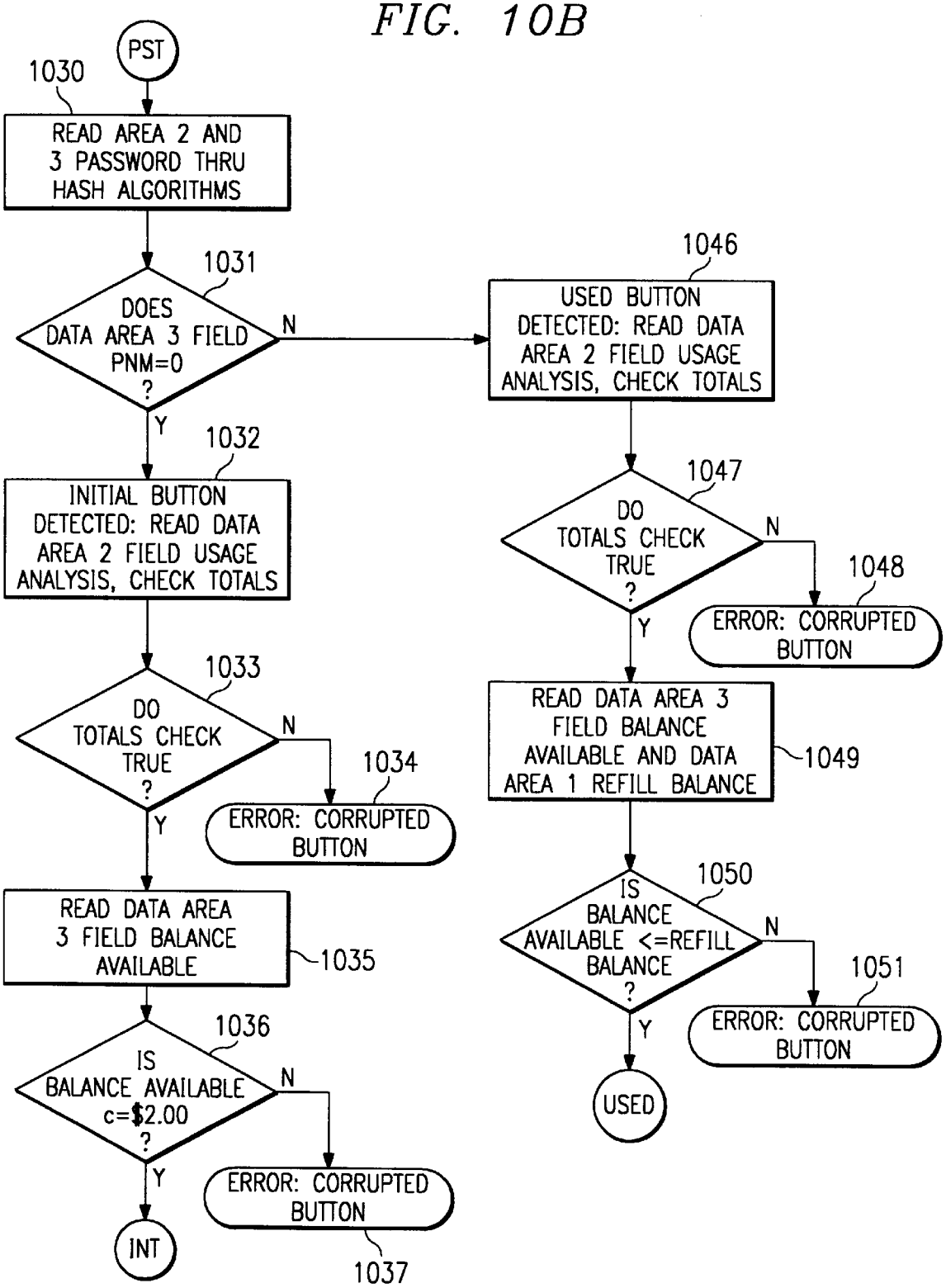
Figure 10C:
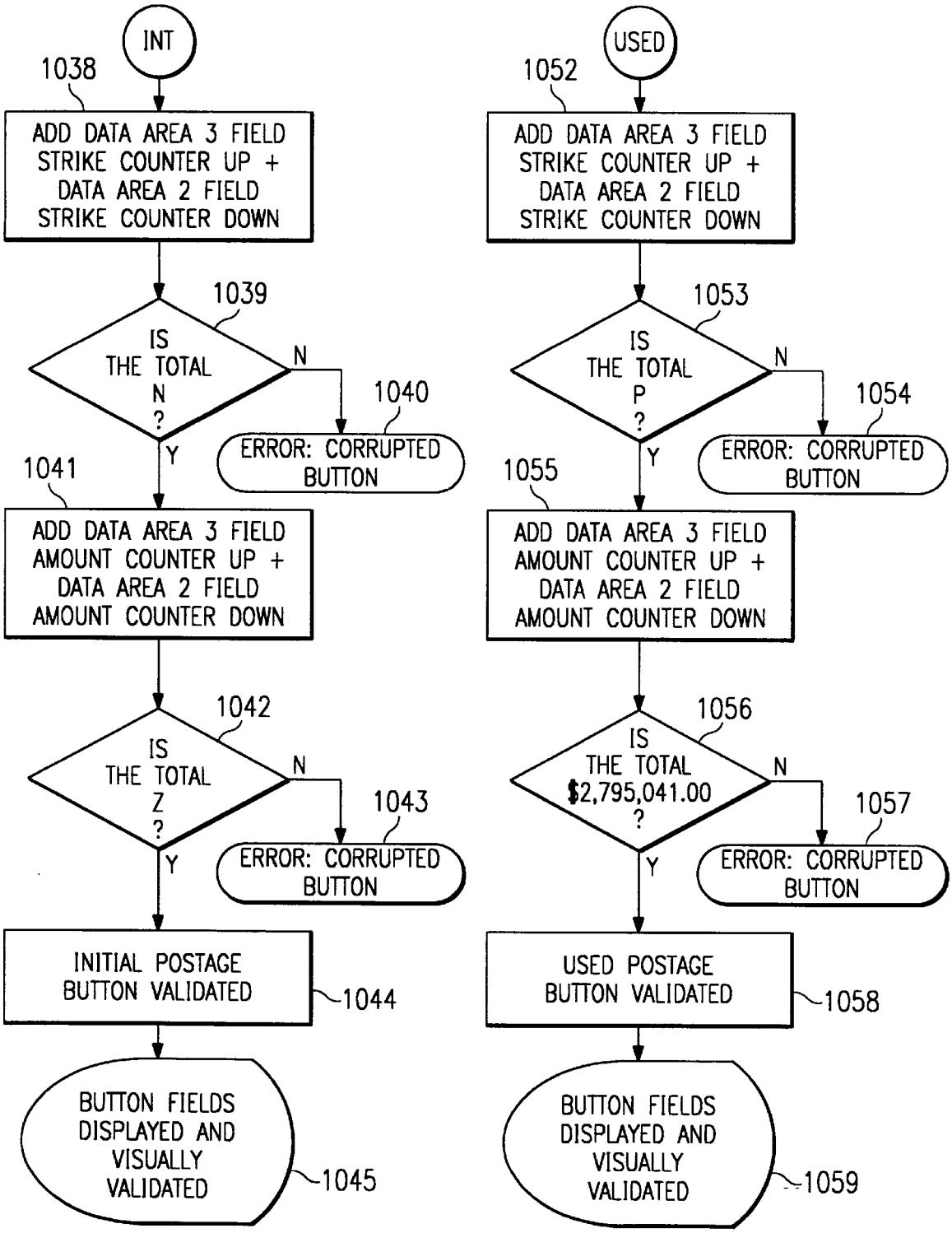

The master, employee and postage buttons are all validated by the Post Office/Refill Station software during refill operations. Each postage button (Level 3) is validated by the customer's E-STAMP software prior to the commencement of any indicia printing operations. The sequences for validating the master, employee and postage buttons using the Post Office/Refill Station software are depicted in FIGS. 10A, 10B and 10C. The sequence for validating a postage button using the customer's E-STAMP software is described below.

Figure 11:
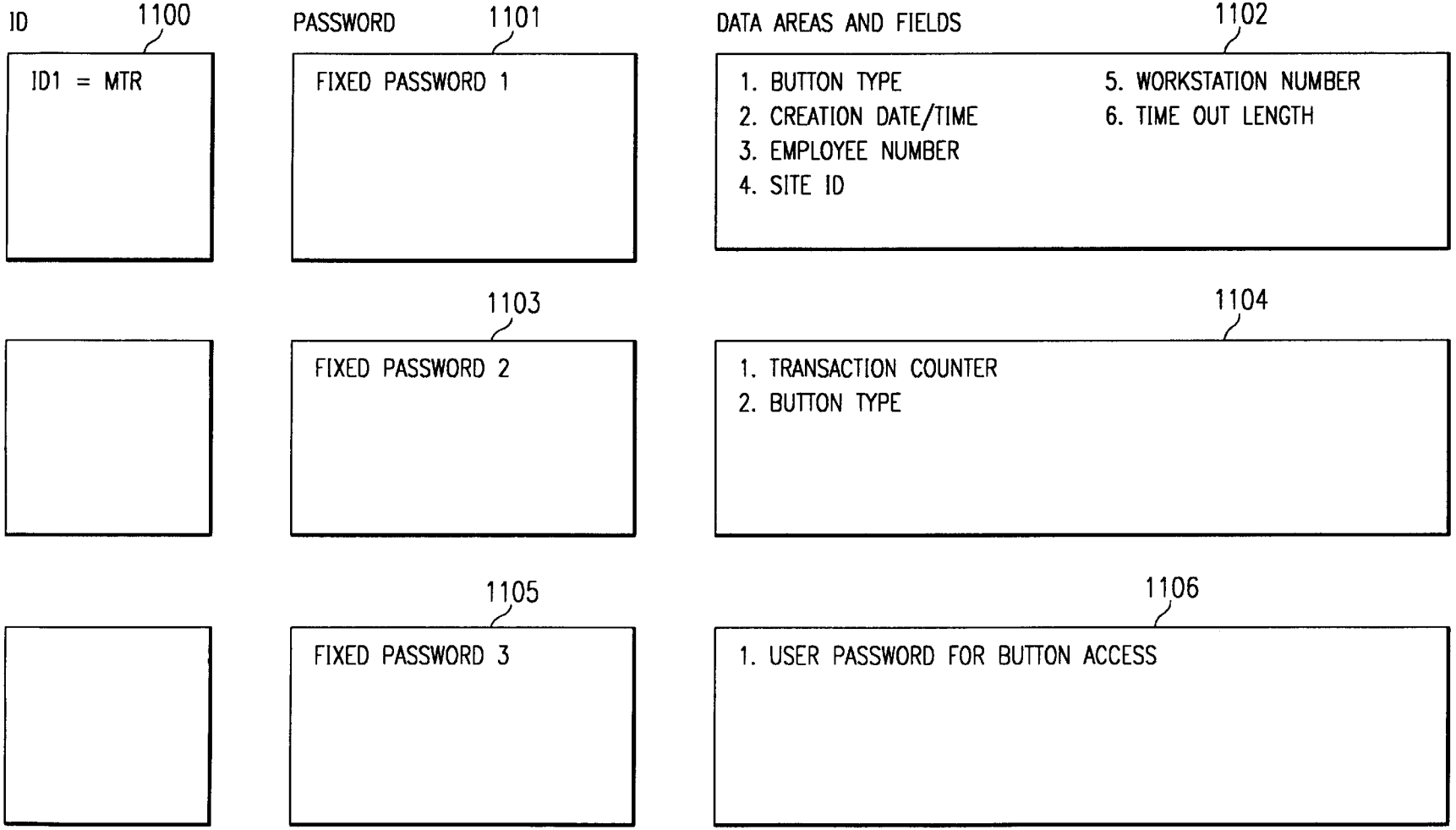
FIG. 11 illustrates how a master button is encoded.

Referring first to FIGS. 10A, 10B and 10C, the Post Office validation procedure for a button coupled to system 10 begins at Step 1000 with the initiation of the Post Office/Refill Station software. For discussion purposes, assume only one TMU button 182 has been coupled to system 10 at this point. At Step 1001, the software reads the unique serial number of the button and verifies that that serial number falls within a range assigned by the button manufacturer to the Post Office; if it does not, an error occurs and processing halts at Step 1002. If the serial number falls into the specified range, then at Steps 1003–1005, an analysis of the button identification code stored in the first identification (ID) area (as will be discussed with respect to FIGS. 11–13) of button 182 is performed to determine whether the button has been programmed as a master, employee or postage button. If no type code is found in the first ID area, then a blank button is identified at Step 1006 and complete programming is required.

For purposes of discussion, the assumption is made that the first button 182 master (MTR) button has been coupled to system 10. The data areas and fields for a TMN button 182 programmed as a master button are described pictorially in FIG. 11. For a master button, ID area 1100 stores the master button type code (MTR). First password area 1101 stores a "fixed" password which has been written-in by the Post Office and controls access to first data area 1102. As used herein "fixed password" refers to a password which may be periodically changed by the Post Office, through the master button holder, but is not regenerated with each refill as are the "generated passwords" described below.

First data area 1102 includes a button type code field (in this case programmed with the master button code), holding data identifying the creation date and time of the button, the creating employee, the site and workstation to which the button is assigned, and a field for data specifying the time out period for Post Office/Refill Station software operation if that software is left running but unused.

Second password area 1103 stores a "fixed" password written by the Post Office which controls access to second data area 1104. Second data area 1104 includes a transaction counter which counts the number of transactions (refills) which occur while the master button is coupled to system 10 and a second button type code field.

Third password area 1105 stores another "fixed" password written by the Post Office allowing access to third data area 1106. Third data area 1106 holds the master button user's personal password which allows the user to log-in, as described below at Step 1107.

When the Post Office/Refill Station software queries a master button 182 at Step 1003, FIG. 10A, the code for a master button is returned (read) from first ID area 1100. In the preferred embodiment, a prompt is then given on the display screen of system 10 and the user of the master button in response inputs the user's personal password at Step 1007. If at Step 1008, the personal password matches that stored in the third data area of the master button, then processing continues; otherwise an error results at Step 1009.

Next, at Step 1010, the button is presented with a first password by the Post Office/Refill Station software; if this password matches the first fixed password written into first password area 1101, then access to first data area 1102 is allowed, otherwise processing halts. In the preferred embodiment, if a match with the password in the corresponding password area does not occur when a password (either "fixed" or "generated") is presented by system 10 software to a given button 182, the button responds by returning a string invalid data without interruption.

Assume access to first data area 1102 is allowed, at Step 1011, the Post Office/Refill Station software queries the button and if a master button type code (MTR) is returned from the button type field of first data area 1102, processing continues to Step 1013, otherwise an error occurs at Step 1012.

At Step 1013 the button is presented with a second password; if this password matches the second fixed password written into second password area 1103, then access is gained to second data area 1104. At Step 1014, the Post Office/Refill Station software queries button 182 and if a master button type code (MTR) is returned from the type field of second data area 1104, then the master button is validated at Step 1015, otherwise an error occurs at Step 1016. When master button validation occurs at Step 1015, a main menu is presented on the screen of system and the master button user can then start the Post Office/Refill Station software operation upon insertion and validation of an employee button.

Next, an employee TMU button 182 is preferably coupled to system 10. The data and fields for a TMU button 182 programmed as an employee button are described pictorially in FIG. 12. For an employee button, ID area 1200 carries an employee type code (EMP). First password area 1201 stores a "fixed" password which has been written by the Post Office under master button control and allows controlled access to first data area 1202.

First data area 1202 includes a button type code field, fields holding data identifying the creation date and time of the button, the using employee, the site and workstation of the user, and the creating master button.

Second password area 1203 stores a second fixed password, written by the Post Office under master button user control, which controls access to second data area 1204.

Second data area 1204 includes a button type code field, a field holding data indicating the total amount of postage issued by the button, and a field holding data indicating the date the button was last used.

Third password area 1205 stores a fixed password, written by the Post Office under master button user control, which allows an employee's personal password to be written into third data area 1206.

Figure 12:
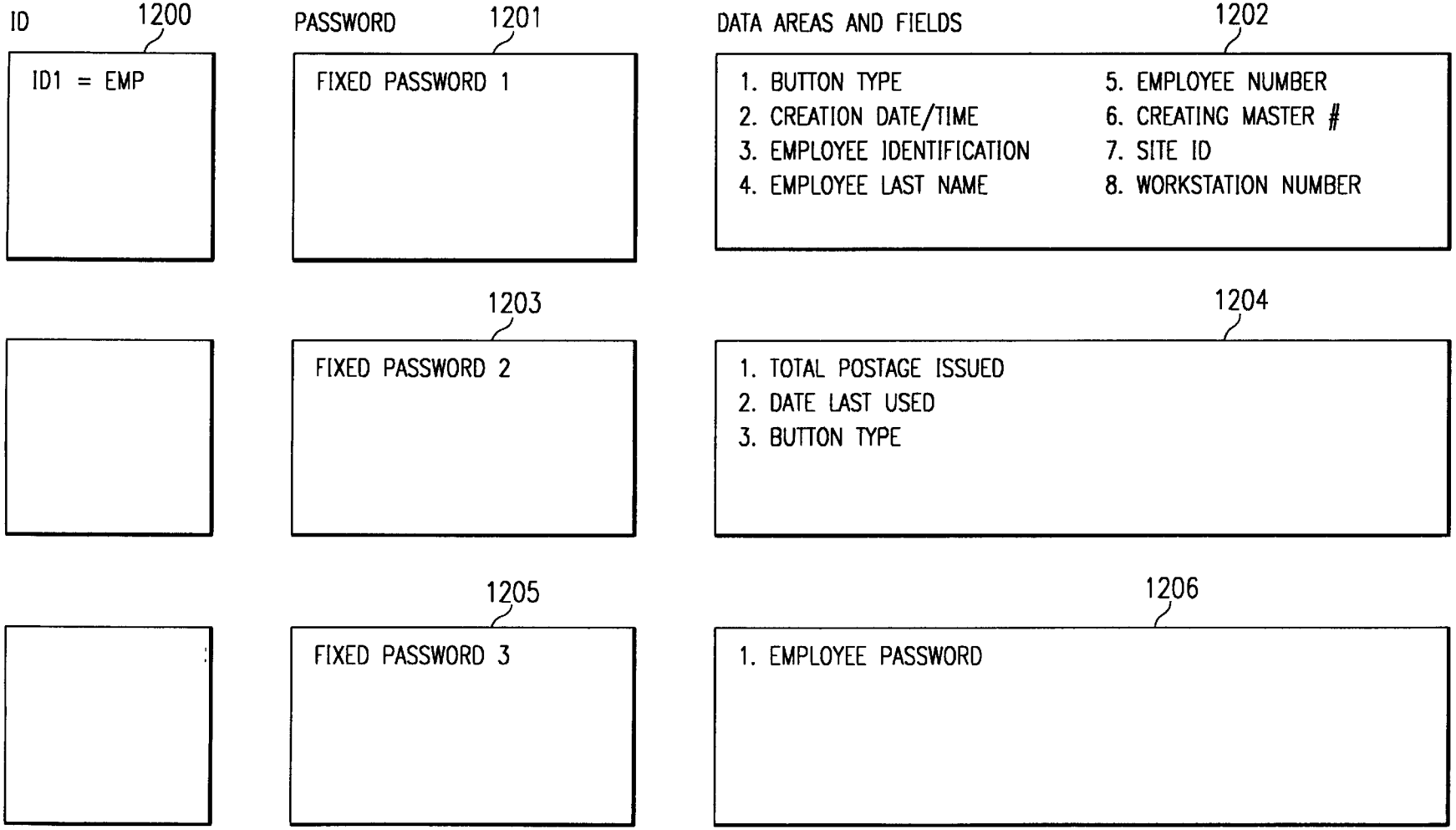
FIG. 12 illustrates how an employee button is encoded.

When the Post Office/Refill Station software queries an employee button at Step 1004 (FIG. 10A), the code for an employee button (EMP) is returned (read) from first ID area 1200 (FIG. 12). In the preferred embodiment, a prompt is given on the screen of system 10 and the employee at Step 1017 inputs a personal password (i.e., logs-in). If the personal password matches that stored in the third data area 1206 (FIG. 12) of the employee button at Step 1018, then processing continues, otherwise an error results at Step 1019.

Next, at Step 1020 (FIG. 10A), the button is presented with a first password by the Post Office/Refill Station software; if this password matches the first "fixed" password written into first password area 1201 (FIG. 12) then access to first data area 1202 is allowed. At Step 1021 (FIG. 10A), the Post Office/Refill Station software queries the button and if an employee type code (EMP) is returned from the type field of first data area 1202 (FIG. 12) processing continues to Step 1023 (FIG. 10A), otherwise an error occurs at Step 1022.

At Step 1023 (FIG. 10A) the button is presented with a second password; if this password matches the second "fixed" password written into second password area 1203 then access is gained to second data area 1204. At Step 1024, the Post Office/Refill Station software queries the button and if an employee button type code (EMP) is returned from the type field of second data area 1204 then the employee button is validated at Step 1025, otherwise an error occurs at Step 1026. When employee button validation occurs at Step 1025, an employee menu is presented on the screen of system 10. The employee may now enter the purchased amount of postage into a validated postage button.

Figure 13:
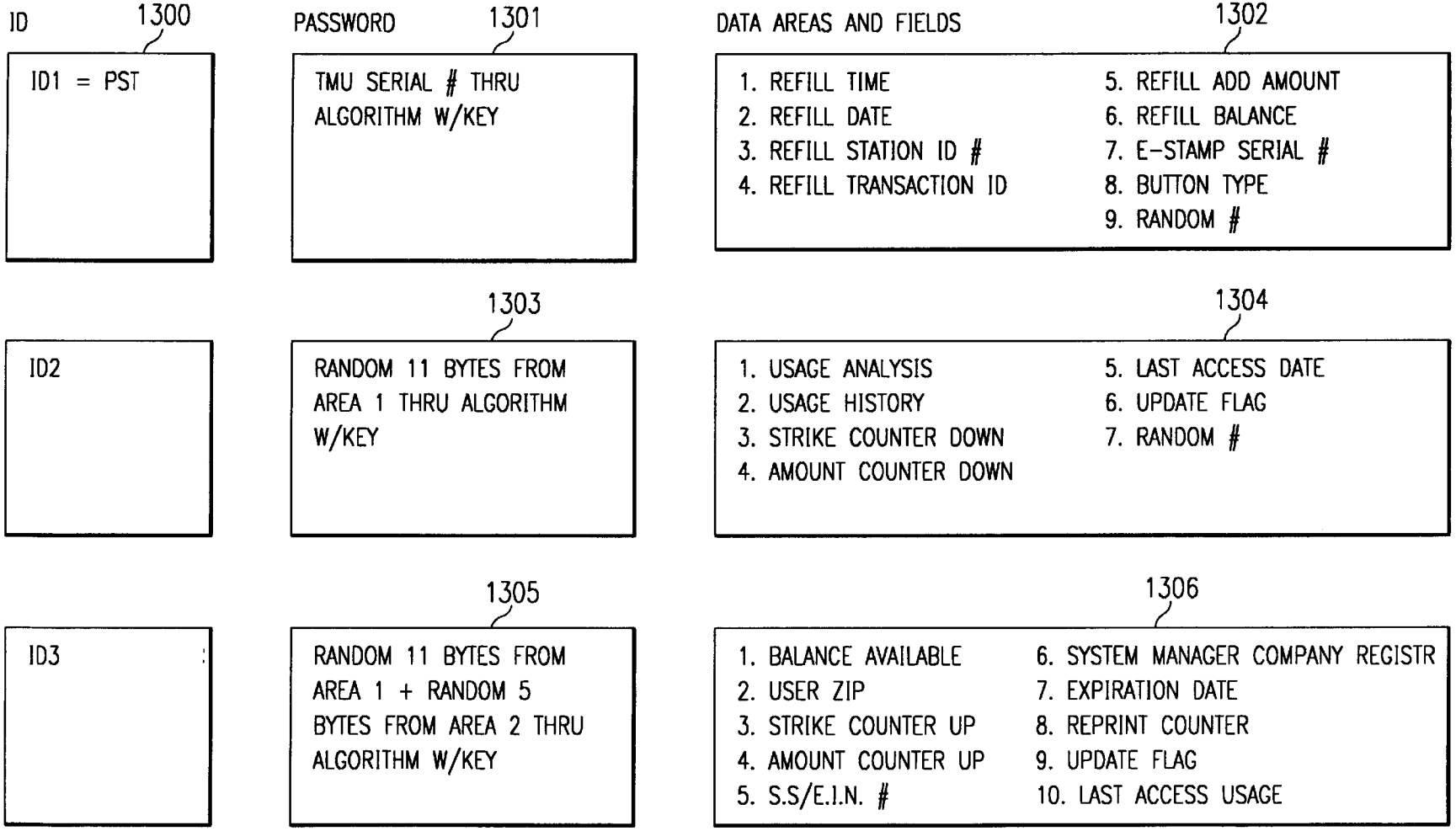
FIG. 13 illustrates how a postage button is encoded.

Assume that a postage TMN button 182 is next coupled to system 10. The data fields and areas for a button programmed as such is depicted in FIG. 13. For a postage button, the I.D. area 1300 stores the postage button type code (PST). The first password area 1301, holds the first generated password, generated, by applying a first hash algorithm (preferably chosen by the system managing company and similar to those illustrated in FIGS. 4A and 4B) to the numerical sequence comprising the unique TMU serial number assigned to that button. The first data areas and fields memory section 1302 is updated by the Post Office/Refill Station software at each refill with data indicating the refill conditions, including the time, date, and site of the refill. Also included as part of programmed refill data is an identification code unique to the Post Office or refill station, a refill add amount data indicative of the amount of postage purchased by the customer, and a refill balance field which holds data indicating the balance within the button after the last refill. First data field 1302 also includes a field which is programmed with the serial number of the authorized user's (customer's) software, a button type code field, and a first string of random numbers described above.

Second password area 1303 of a postage button holds a second generated password which is updated with each refill by operating on the string of random data in first data area 1302 with a second hash algorithm, similar to the second level algorithm depicted in FIGS. 4A and 4B. Second data area 1304 for a postage button, includes fields holding usage history and analysis data, a field holding data indicating the last access date, a strike down-counter which decrements by from a predetermined initial value by one each time an indicia is printed, an amount down-counter which decrements from a predetermined initial value by the postage amount used as each indicia is printed, an update flag, and a second string of random numbers.

The usage analysis field is divided into a number of categories according to postage amount. The tally in each category is incremented by one each time that category's corresponding postage amount is used. The usage analysis field is preferably cleared each time postage is added. The usage history field is also divided into a number of categories representing the type of postage being printed (i.e., first class, priority, third class, fourth class, express, special, international). The tally in a given category in the usage history is incremented by one before each printing of an indicia of the corresponding type.

The update flag in the second data area 1304 and another update flag in the third data area 1306 keep track of updates. The update flags also indicate whether or not the refill operation was performed in the right order. For a valid button, these two flags are equal. If these update flags are not equal, perhaps due to a power failure or program interrupt, the button becomes invalid for use. In the preferred embodiment, the refill order of events are: read button (decript), change information (encript), write button area 3, update area flag, write button area 2, update area flag, update customer file, and print.

Third password area 1305 holds the password generated with each refill by operating on the 11 bytes of random data from first data area 1302 and 5 random bytes from second data 1304. Third data area 1306 includes a field which holds data indicating the balance available, a field indicating the user zip code, a field holding a personal or business identification number of the user, the registration number of the customer's printing software, a field holding data indicating the expiration date (the last possible date for the next refill), the update flag described above and a field containing data indicating the total postage used on the last access date.

Data area 3 also contains a strike up-counter, an amount up-counter, and a reprint counter. The strike up-counter increments by one from a predetermined initial value each time an indicia is printed, the amount up-counter increments from a predetermined initial value by the postage amount printed at each use. The reprint counter counts the number of reprints made since the last refill (the customer software will allow for the reprint of the indicia for the last address and envelope printed).

When the Post Office/Refill Station software queries a postage button at step 1005 (FIG. 10A), the postage button type code (PST) is returned from first password area 1300 (FIG. 13). Next, at step 1027 (FIG. 10A) the Post Office/Refill Station software transmits to the button a password generated by applying the first hash algorithm to the numerical sequence of the TMU serial number for the given button 182. If the password generated by the Post Office/Refill Station software matches that stored in first password area 1300, access to first data area 1302 is allowed and processing continues at step 1028; otherwise a string of invalid data is received from the button.

At step 1028 (FIG. 10A), the Post Office/Refill station software reads the button type field in first data area 1302. If the button returns the proper postage button code processing continues; otherwise an error occurs at 1029 and processing halts.

Next, the Post Office/Refill Station software reads the second and third password areas using the second and third hash algorithms, examples of which are shown in FIGS. 4A and 4B. Specifically, the Post Office/Refill Station software takes the string of random data acquired by gaining access to a first data area 1302 and applies the second hash algorithm thereto. The resulting password is then transmitted to the button and if a match occurs with the password in second password area 1303, access is gained to second data area 1304; otherwise a string of invalid data is received from the button. The Post Office/Refill Station software then takes the 11 bytes of random data from first data area 1302, 5 bytes of random data from second data area 1304 and applies the third hash algorithm thereto. The resulting password is transmitted to the button and if a match occurs with the password held in third password area 1305, access is gained to third data area 1306; otherwise a string of invalid data is received from the button.

At step 1030 (FIG. 10B), the Post Office/Refill Station software reads the system managing company registration number field in third data area 1306 of the button. Assuming that the data in this field is equal to zero (step 1031), then an initial button has been detected. The processing proceeds to step 1032 and Post Office/Refill Station software reads the usage analysis field of second data area 1304. At step 1033, the totals in the usage analysis field are checked against an expected initial value. If the totals are not true, then the button is corrupted and processing stops at step 1034. Otherwise, the processing continues with step 1035, where the balance available field in third data area 1306 (FIG. 13) is read. In the preferred embodiment, the balance available field initially is set to two dollars. If at step 1036, the Post Office/Refill Station software determines that the balance in the balance available field is less than or equal to two dollars, the processing continues; otherwise the button is determined to be corrupted and an error occurs at step 1037.

At step 1038 (FIG. 10C), the value in the strike up-counter of third data area 1306 (FIG. 13) is added to the value in the strike down-counter of second data area 1304. Since the strike down-counter always decrements from a predetermined initial value by one each time an indicia is printed and the strike up-counter always simultaneously increments by one from an initial value, their total must always equal the same value N. Thus, if at step 1039 the sum of the values in the strike up- and down-counters equals predetermined value N processing continues; otherwise the button is determined to be corrupted at step 1040.

Next, at step 1041 (FIG. 10C) the value in the amount down-counter of data area 2 and the value in the amount up-counter in data area 3 are summed. Since the value in the amount up-counter increments by the amount of postage printed with each indicia from an initial value and the amount down simultaneously decrements (by the same amount), the sum of their values must always equal the same value Z. Thus, at step 1042, if the total of the amount counter data read from the button does not equal predetermined value Z, processing is halted at 1043 and the button determined corrupted; otherwise, at step 1044, the initial postage button is validated.

At step 1045 (FIG. 10C), customer software serial number, last access date, balance available, user zip code, customer personal identification, system managing company registration number, expiration data and reprint counter value are displayed and checked visually. The initial button is then ready for initial data input, including input of the customer registration number received from the system managing company and the purchased amount of postage.

Returning to step 1031 (FIG. 10B), if the system managing company registration number in third data area 1306 is not equal to zero, then a used postage button has been detected and processing precedes to step 1046. At steps 1046 and 1047, the usage analysis totals are again read and checked as described above for steps 1031 and 1033. If the totals are not true, then an error results at 1048 since the button has been corrupted; otherwise, the processing continues with step 1049.

At step 1049 (FIG. 10B), the balance available field of third data area 1306 and refill balance field of first data area 1302 are read. At step 1050, a check is made to determine if the balance available is less than or equal to the refill balance. If not, a corrupted button is detected at step 1051. If the check at step 1050 reveals that the button is valid, then at steps 1052–1054 (FIG. 10C) a test of the strike counter data is performed as was described above for steps 1038–1040. Similarly, at steps 1055–1057 a check is made of the values in the amount counter as was also described above at steps 1041–1043.

Once all the checks of the use button are completed, validation takes place at Step 1058 (FIG. 10C). Then, at step 1059 the E-STAMP serial number, last access date, balance available, user zip code, customer and personal identification, system managing company registration number, expiration date, and reprint counter value are displayed and checked visually.

In the case of a validated initial button, the Post Office employee can then put the system managing company registration number, which has been duly issued to an authorized customer and presented to the Post Office, into the button. The employee can also put into the button the amount of postage purchased by the customer. In the case of a validated previously used button, the Post Office employee can put in the amount of postage purchased.

With each refill operation, the Post Office/Refill Station software automatically updates the data in the data fields on the postage button refilled including the random data strings. This data, with the exception of the generated passwords and the random number strings, along with the serial number of the refilling master button, the identification number from the employee identification button is read and stored by the Post Office/Refill Station software. This allows the Post Office to track each refill operation being performed. At this point, new or modified indicia can be added to the portable memory, for subsequent use by a user at his/her PC.

As described above, at least the second and third passwords in each postage button are updated with each refill. Each initial button is blank and all these passwords must be programmed-in. A password, which is preferably generated applying a first hash algorithm to the unique TMU serial number assigned to each button, is written into password area 1. This first password is preferably generated by the system managing company.

By presenting button 182 with an independently generated matching first password, the Post Office/Refill Station software is allowed access to data area 1 of the button. The Post Office/Refill Station software then generates and writes a string of bytes of random data into first data area 1302. Next, the Post Office/Refill Station software applies a second algorithm, such as the second level algorithm depicted in FIGS. 4A and 4B, to generate a second password which is written into the second password area of the button being programmed. Subsequently, matching the second password allows access to second data area 1304 of the button by the Post Office/Refill Station software and the customer's software. Next, the Post Office/Refill Station software generates and writes a string of random data into the second data area. The Post Office/Refill Station software applies a third algorithm, such as the third level algorithm of FIGS. 4A and 4B, to the random data in second data area 1304 to generate a third password which is written into the third password area of the button. Matching the third password allows access to the associated third data area 1306. Thereafter, the strings of random data in the first and second data areas, and correspondingly the second and third passwords, are updated with each refill of the button by the Post Office using the Post Office/Refill Station software once initial reading and access has been accomplished.

Whenever a customer brings a TMU button 182 to the Post Office/Refill Station to be loaded with an amount of postage, the postal employee may provide that customer with a selection of graphic configurations for the postal meter stamp. The customer may select one or more configurations and have the postal employee transfer the selected configurations into the memory of TMU button 182.

Alternatively, the Post Office may program disposable TMU buttons 182 to be sold over-the-counter or through automatic vending machines. Disposable TMU buttons 182 would be preloaded with various monetary values of postage (e.g., $1, $5, $10, $20). These TMU buttons 182 would be directly obtained from the manufacturer and would be initially loaded with postage values by the Post Office. They could have different graphical presentations for the entire button, or for selection by a user on a use by use basis.

Only authorized Post Office employees would be able to load postage into disposable TMU buttons 182. Both a valid master (MTR) button and a valid employee (EMP) button would have to be coupled to the Post Office's system 10 (POSTAGEMAKER) before disposable TMU buttons 182 could be filled with postage.

Not only may the Post Office load TMU buttons 182 with various monetary values of postage, but the Post Office may also load postage storage devices 18 with different configurations of postage indicia. These configurations could be similar to the various graphic configurations printed on commemorative stamps sold by the Post Office. These configurations could be generated from scanned images or could be programmed using a variety of graphics programs.

Selected configurations can be imported into the E-STAMP program once the user's E-STAMP program has validated TMU button 182. For example, if the user were to select the "Other" option in box 816, FIG. 8, the user would have an option to import the postage indicia configurations from TMU button 182 or from a graphics program coupled to the E-STAMP program by using a "merge" command.

PORTABLE MEMORY VALIDATION

Referring next to FIGS. 14A and 14B, the customer validation procedure for a postage button coupled to the customer's system 10 begins at Step 1400 with the initiation of the customer software program. At Step 1401, the software reads the unique serial number of the button and verifies that that serial number falls within a range assigned by the button manufacturer to the Post Office; if it does not, an error occurs and processing halts at Step 1402 otherwise processing continues to Step 1403.

When the customer software queries a postage button (portable memory) at step 1403, the postage button type code (PST) should be returned from postage button first password area 1300 (FIG. 13) and processing continues to step 1406, otherwise an error occurs at step 1404. Next, at step 1406 the customer software transmits to the button a password generated by applying a first hash algorithm to the numerical sequence of the TMU serial number for the given button 182. If the password generated by the customer software matches that stored in first password area 1301, access to first data area 1302 (FIG. 13) is allowed and processing continues at step 1407; otherwise a string of invalid data is received from the button as described above.

At step 1407, the customer software reads the button type field in first data area 1302. If the button returns the postage button code previously known by the software loaded on the customer's computer then processing continues, otherwise an error occurs at step 1408 and processing halts. Assuming the correct button code is read at step 1407, at step 1409 the customer software reads the second password area 1303 using a second hash algorithm, an example of which is shown in FIGS. 4A and 4B. Specifically, the customer software takes the string of random data acquired by gaining access to a first data area 1302 and applies the second hash algorithm thereto. The resulting password is then transmitted to the button and if a match occurs with the password in second password area 1303, access is gained to second data area 1304; otherwise a string of invalid data is received from the button. If access to second data area 1304 is gained at step 1409, then at step 1410 the customer software reads the last access date field of second data area 1204. If the last access date written into this field is before the current date processing continues, otherwise an error occurs at step 1411.

Next, at step 1412 the customer software attempts to gain access to third data area 1306 (FIG. 13) of the postage button coupled to the customer's system 10. In this instance, customer software then takes 11 bytes of random data from first data area 1302 and 5 bytes of random data from second data area 1304 and applies the third hash algorithm thereto. The resulting password is transmitted to the button and if a match occurs with the password held in third password area 1305, access is gained to third data area 1306; otherwise a string of invalid data is received from the button.

Assuming access to third data area 1306 (FIG. 13) is gained at step 1412, at step 1413 the customer software reads the balance available field of third data area 1306 and the refill balance field of first data area 1304. If the balance available is less than or equal to the refill balance then processing continues, otherwise a corrupted button is detected at step 1414. For an uncorrupted button, the user zip code written into the user zip code field of third data area 1306 is read and compared at step 1415 with the user zip code assigned to the customer's software and stored on the customer's computer. If they match processing continues, otherwise an error occurs at step 1416 since a postage button cannot be used outside the zip code assigned to the corresponding customer software. This feature is (like all security levels in the system) optional, and can be modified to include several zip codes, if desired.

For example, disposable TMU buttons 182 would generally not be limited to use within a specific zip code.

At step 1417, the customer software reads the value in the amount up-counter of third data area 1306 and compares it with a corresponding amount value totalled and stored by the customer software. The amount up- and down-counters in each button are never cleared during the life of the button. Thus, if the amount in the button amount up-counter is greater than or equal to the amount in the customer software file the button passes at step 1417, otherwise an error occurs at step 1418. A similar test is performed at step 1419 where the customer software reads the value in the strike up-counter and compares it with a corresponding strike tally kept by the customer software. Again, since the strike counters are never cleared, the value in the strike counter must be greater than or equal to the total in the software file, otherwise at step 1420 an error occurs.

At step 1421, the value in the strike up-counter of third data area 1306 is added to the value in the strike down counter of second data area 1304. Since the strike down-counter always decrements from a predetermined initial value by one with the printing of each indicia and the strike up-counter always increments by one from an initial value simultaneously, their total must always equal the same value N. Thus, if at step 1422 the sum of the values in the strike up- and down-counters equals predetermined value N processing continues, otherwise the button is determined to be corrupted at step 1423.

Next, at step 1424 the value in the amount down-counter of second data area 1304 and the value in the amount up-counter in third data area 1306 are summed. Since the value in the amount up-counter increments by the amount of the postage used with the printing of each indicia from and initial value and the amount down-counter simultaneously decrements from an initial value by the same amount, the sum of their values must always equal the value Z. Thus, at step 1425, if the total of the amount counter data read from the button equals value Z, then processing continues, otherwise an error occurs at step 1426 and processing is halted.

At step 1429, the customer software reads the last access date written into the corresponding field in second data area 1304. If the recorded last access date is the same as or before the present date the button passes, otherwise an error occurs at step 1430. This prevents the entering of random data into the portable memory.

At step 1431, the expiration date written into the expiration date field of third data area 1306 is read to determine if the button has expired. If the current date is before the expiration date, the button is still valid, otherwise at step 1432 the button is determined to be expired.

At step 1433 a check is made of the update flags described above. The update flag in second data area 1304 must be equal to the update flag in third data area 1306, otherwise an error has occurred during the update sequence and processing stops at 1434.

If the postage button 182 coupled to the customer's system 10 passes the last test at step 1433, the button is validated at step 1435 and the customer can now print postage indicia up to the refill balance available.

Figure 15A:
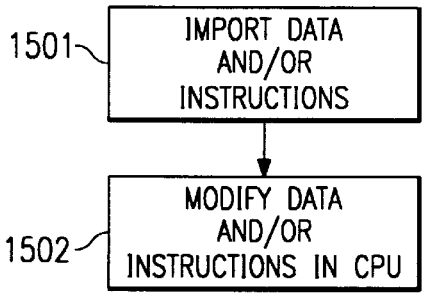
FIGS. 15A and 15B show the importation and exportation of data.

FIG. 15A shows a block diagram of data and/or instructions being imported (1501) from any other application program (not shown) running on processor-based system 10. This data importation would be accomplished in the manner now well known in the art. This imported data is transferred into the central system, 1502, for modifying the CPU information, or the data stored on the portable memory. An example of such imported data would be the importation of graphical configurations from a TMU button 182 or from another application program or from modem 101 (FIG. 1) into the E-STAMP program to be printed on a piece of mail as the meter stamp. Another example is the importation of encrypted information into the E-STAMP program either as a bar coded message to be printed separately from the postage meter stamp or as a part of the postage meter stamp.

Figure 15B:
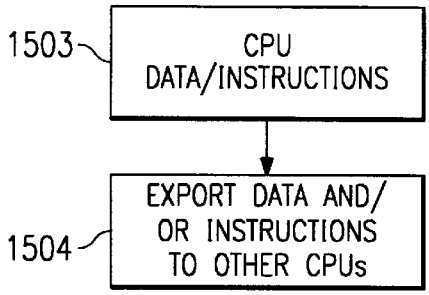

FIG. 15B shows the reverse, in blocks 1503 and 1504, where data and/or instructions are exported from the E-STAMP or POSTAGEMAKER system to any other application running on the same CPU. An example of this exportation of data would be the export of information on addressee, amount of postage, person to be billed for postage, etc., to a database program whereby a user could generate client billing information and keep track of user's overall expenditure of postage. Another example of exported information would be the transfer of information from the POSTAGEMAKER program to a database program to compile sales records and market forecasts for the Post Office by postal location.

This import or export of data as shown in FIGS. 15A and 15B could be to or from a remote CPU over modem 101 (shown in FIG. 1).

The aforementioned E-STAMP and POSTAGEMAKER programs have been shown and described with respect to a "windows" operating environment on a PC. Of course, other means could be employed for implementing the present invention within a processor-based system.

Although the present invention and its advantages have been described in detail, it should be understood that various changes, substitutions and alterations can be made herein without departing from the spirit and scope of the invention as defined by the appended claims.

What is claimed is:

1. A processor-based system for printing a desired amount of postage for mailing a document created within said system, said system comprising:

means for temporarily coupling said system to a postage storage device;

means controlled in part by said postage storage device for automatically calculating a correct amount of postage for a particular one of said documents as a function of mailing parameters entered into said system and specific to said particular document;

means for formatting data to be sent to a general purpose printer coupled to said system, wherein said formatted data is operable to print said correct amount of postage; and means for creating a personalized postage indicia together with said correct amount of postage, wherein at least one characteristic of said personalized postage indicia is personalized by a user of said system independent of said mailing parameters, said creating means operable in temporal proximity to said formatting means.

2. The system of claim 1 further comprising:

means for generating a plurality of graphical configurations of postage indicia for selectively printing together with said postage.

3. The system of claim 1 further including:

means for selecting a particular graphical configuration of postage indicia; and means controlled by a system user for personalizing said selected graphical configuration.

4. The system set forth in claim 3 further including:

means for printing said personalized graphical configuration of postage indicia together with said correct amount of postage.

5. The system set forth in claim 1 wherein said postage indicia creating means includes:

means for selecting from a plurality of preestablished postage indicia.

6. The system set forth in claim 5 wherein at least one of said preestablished postage indicia is prestored on said postage storage device.

7. The system set forth in claim 6 further comprising:

means for selectively modifying said at least one preestablished postage indicia on said postage storage device.

8. The system of claim 1 wherein said postage indicia creating means includes a plurality of graphical configurations of postage indicia.

9. The system of claim 8 further including:

means for allowing a system user to select one of said graphical configurations for the printing of said indicia.

10. The system set forth in claim 9 wherein said selecting means includes:

means for selecting from a menu of choices provided to said system user.

11. The system of claim 1 wherein said postage indicia creating means includes:

means for receiving input from a system user on a use by use basis.

12. The system of claim 11 wherein said postage storage device is restricted for use within a particular time period.

13. The system of claim 11 further comprising:

means for storing in said postage memory a running balance of value of postage printed.

14. The system of claim 13 further comprising:

means for automatically deducting said correct amount of postage from a total amount of postage stored in said postage storage device.

15. The system of claim 11 further comprising:

means for automatically generating an encrypted message as a function of said mailing parameters entered into said system.

16. The system of claim 15 wherein said encrypted message is in a PostNet Zip+4 format.

17. The system of claim 15 wherein said encrypted message is in a two dimensional bar code.

18. A method of printing a desired amount of postage for mailing a document created within a general purpose processor based system, said method comprising the steps of:

automatically calculating a correct amount of postage for a particular one of said documents as a function of mailing parameters specific to said particular document;

formatting data operable for printing said correct amount of postage; and wherein said formatting step includes the step of:

creating, at least in part on said general purpose processor based system having a portable memory coupled thereto, a postage indicia together with said correct amount of postage, said postage indicia formatted for printing together with said correct amount of postage, wherein said creating step includes receiving information from a system user regarding said postage indicia independent of said mailing parameters and independent of information with respect said system user, said creating step being substantially contemporaneous with printing said correct amount of postage.

19. The method of claim 18 wherein said creating step further includes the step of:

generating a plurality of graphical configurations of postage indicia for selectively printing together with said postage.

20. The method of claim 18 wherein said creating step further includes:

personalizing said created postage indicia under control of a system user.

21. The method set forth in claim 20 wherein said at least one graphical configurations of postage indicia contains limitations on use provided by a controlling postage agency.

22. The method of claim 18 wherein said creating step includes the step of:

communicating with a data source to obtain at least one preestablished graphical configurations of postage indicia.

23. The method set forth in claim 22 wherein said last-mentioned communicating step includes:

selecting from a menu of choices.

24. The method set forth in claim 18 wherein said instruction from said system user includes the step of:

selecting from a plurality of preestablished postage indicia.

25. The method of claim 24 wherein at least one of said preestablished postage indicia is restricted for use within a particular time period.

26. The method set forth in claim 24 wherein at least one of said preestablished postage indicia is stored on said portable memory.

27. The method set forth in claim 26 further including the step of:

selectively modifying said at least one preestablished postage indicia.

28. A system for printing postage indicia on a mailing envelope, said system comprising:

a portable memory for storing thereon a plurality of said postage indicia;

a general purpose processor-based system having stored thereon a plurality of application programs, said general purpose processor-based system executing a particular application program of said plurality of programs temporarily defining said general purpose processor-based system as a postage printing system;

means for temporarily associating said portable memory with said postage printing system; and means controlled in part by said stored plurality of postage indicia for creating an user selected postage indicia for printing.

29. The system set forth in claim 28 wherein said postage indicia is stored on said portable memory by a processor located remote from said system.

30. The system set forth in claim 28 wherein said system further includes:

means for printing postage together with said postage indicia.

31. The system of claim 28 wherein said remotely located processor establishes limitations for each postage indicia.

32. The system of claim 28 wherein said postage creating means includes means for selecting from a plurality of graphical configurations of postage indicia.

33. The system of claim 32 further including:

means for allowing a system user to modify a selected one of said graphical configurations for the printing of said indicia.

34. The system set forth in claim 33 wherein said last-mentioned means includes:

means for selecting from a menu of choices provided to said system user.

35. A method for printing postage indicia on a mailing envelope, said method comprising the steps of:

prestoring on a portable memory at least one of said postage indicia;

executing a postage metering program on a general purpose processor-based system;

temporarily associating said portable memory with said processor based system; and creating under joint control of said postage metering program operating on said processor based system and said portable memory a user selected postage indicia.

36. The method set forth in claim 35 wherein said postage indicia is stored on said portable memory by a processor located remote from said system, said portable memory also containing data representative of prepaid postage values.

37. A method for printing postage indicia on a mailing envelope, said method comprising the steps of:

storing data in a general purpose processor based system having a postage credit memory device coupled thereto, said data for creating at least one of said postage indicia;

selecting under control of a user from said stored data a particular postage indicia, wherein said selecting step includes receiving input from said user regarding selection of said postage indicia; and printing on a general purpose printer said selected postage indicia under control of said processor based system, wherein said user input of said selecting step is received substantially contemporaneously with printing said postage indicia.

38. The method of claim 37 wherein said selecting step includes the step of:

receiving input instructing from a system user for modifying said selected indicia.

39. The method set forth in claim 37 wherein said selecting step includes the steps of:

substituting for said stored data other data from said user for controlling the printing of a selected indicia.

40. A method of controlling printing a selected postage indicia on a piece of mail, said method comprising the steps of:

displaying a plurality of said postage indicia on a general purpose processor-based system screen, said general purpose processor-based system having a portable memory temporarily associated therewith; and selecting under control of a user a particular one of said displayed indicia, said selected indicia being transmitted to a printer, wherein said selecting step is performed in temporal proximity to transmitting said selected indicia to said printer.

41. The method set forth in claim 40 further including the step of:

modifying at least a portion of a selected displayed indicia under control of a system user.

42. The method set forth in claim 40 wherein said portable memory includes data pertaining to at least one of said displayed postage indicia.

43. A method for use in a general purpose CPU for generating personalized postage indicia messages in conjunction with a printed postage amount, said method comprising the steps of:

interfacing with a user and with a program operating in said general purpose CPU for generating an amount of postage to be printed on a mailing piece for a particular piece of mail, said general purpose CPU having a portable memory containing prepaid postage amounts operative to control said postage amount generating step removably coupled thereto;

selecting a desired indicia from a pre-established data base of possible indicia, wherein said selecting step includes receiving instruction with respect to said desired indica from an operator of said general purpose CPU; and printing said generated postage amount together with said selected indicia on said particular piece of mail, wherein said printing step is operable substantially contemporaneously with said receipt of operator instruction.

44. The method set forth in claim 43 further including the step of:

personalizing said selected indicia under control of said user.

45. The method set forth in claim 43 wherein said preestablished data base is loaded into said CPU from said portable memory.

46. The method set forth in claim 43 wherein said pre-established data base is remotely located from said CPU.

47. In combination, means under control of said user for interfacing on a use by use basis with a user of a general purpose processor operating a program which controls the amount of, and printing of, postage amounts on mailing envelopes, said general purpose processor having a portable memory containing data for operating in cooperation with said processor program removably coupled thereto;

means for creating a desired graphical presentation, said creating means being independent of information with respect to a particular user and a particular mailing envelope; and means for printing said created presentation in conjunction with the printing of a desired postage amount on a mailing envelope.

48. The invention as set forth in claim 47 wherein said creating means includes means for selecting a desired graphical presentation from a pre-established data base of such presentations.

49. The invention as set forth in claim 48 wherein said preestablished data base is included on said portable memory.

50. The invention as set forth in claim 47 wherein said creating means is operative for a selected number of postage printings.

51. A general purpose processor-based system for printing a desired amount of postage for mailing a document created within said system, said system comprising:

means for communicating between said system and a postage storage memory;

means for determining a correct amount of postage for a particular one of said documents;

means for selecting a particular postage indicia to be printed with said correct amount of postage, said selecting means operable upon input of a user of said system; and means for formatting data to be sent to a printer coupled to said system, wherein said formatted data is operable to print said correct amount of postage together with a selected particular postage indicia, wherein said formatting means and said selecting means are operable substantially contemporaneously.

52. The system of claim 51 further comprising:

means for generating a plurality of graphical configurations of postage indicia for selectively printing together with said postage.

53. The system of claim 51 further including means for selecting a particular graphical configuration of postage indicia; and means controlled by a system user for personalizing said selected graphical configuration.

54. The system set forth in claim 53 further including:

means for printing said personalized graphical configuration of postage indicia together with said correct amount of postage.

55. The system set forth in claim 51 wherein said postage indicia selecting means includes:

means for selecting from a plurality of preestablished postage indicia.

56. The system set forth in claim 55 wherein at least one of said preestablished postage indicia is prestored in said postage storage memory.

57. The system set forth in claim 56 further comprising:

means for selectively modifying said at least one preestablished postage indicia on said postage storage device.

58. The system of claim 51 wherein said postage indicia selecting means includes means for obtaining said postage indicia from said postage storage memory.

59. The system of claim 58 wherein said postage memory includes a plurality of different graphical configurations and wherein said system further includes means for allowing a system user to select one of said graphical configurations for the printing of said indicia.

60. The system set forth in claim 59 wherein said last mentioned means for allowing selection includes:

means for selecting from a menu of choices provided to said system user.

61. The system of claim 51 wherein said postage indicia selecting means includes:

means for receiving input from a system user on a use by use basis.

62. The system of claim 61 wherein said postage storage device is restricted for use within a particular time period.

63. The system of claim 61 further comprising:

means for storing in said postage memory a running balance of value of postage printed.

64. The system of claim 63 further comprising:

means for automatically deducting said correct amount of postage from a total amount of postage stored in said postage storage device.

65. The system of claim 61 further comprising:

means for automatically generating an encrypted message as a function of mailing parameters entered into said system.

66. The system of claim 65 wherein said encrypted message is in a PostNet Zip+4 format.

67. The system of claim 65 wherein said encrypted message is in a two dimensional bar code.

68. A method of creating a selected postage indicia, said method comprising the steps of:

displaying a plurality of said postage indicia on a general purpose processor-based system screen, said general purpose processor-based system having a postage memory device temporarily associated therewith;

selecting under control of a user a particular one of said displayed indicia for transmittal to a printer; and printing said selected particular one of said postage indicia, wherein said printing step is performed substantially contemporaneously with said selecting step.

69. The method set forth in claim 68 wherein said selecting step includes the step of:

personalizing said selected indicia.

70. The method set forth in claim 68 further including the step of:

modifying at least a portion of a selected displayed indicia under control of a system user.

* * * * *